US010223909B2

(12) United States Patent
Margulici et al.

(10) Patent No.: US 10,223,909 B2
(45) **Date of Patent: *Mar. 5, 2019**

(54) ESTIMATING TIME TRAVEL DISTRIBUTIONS ON SIGNALIZED ARTERIALS

(71) Applicant: Uber Technologies, Inc., San Francisco, CA (US)

(72) Inventors: J. D. Margulici, Oakland, CA (US); Kevin Adda, Santa Clara, CA (US); Andre Gueziec, Santa Clara, CA (US); Edgar Rojas, Santa Clara, CA (US)

(73) Assignee: Uber Technologies, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/058,195

(22) Filed: Oct. 18, 2013

(65) Prior Publication Data

US 2014/0129124 A1 May 8, 2014

Related U.S. Application Data

(63) Continuation-in-part of application No. 13/752,351, filed on Jan. 28, 2013, now Pat. No. 8,781,718.

(60) Provisional application No. 61/715,713, filed on Oct. 18, 2012.

(51) Int. Cl.
*G08G 1/01* (2006.01)

(52) U.S. Cl.
CPC ..... *G08G 1/0112* (2013.01); *G08G 1/0116* (2013.01); *G08G 1/0129* (2013.01)

(58) Field of Classification Search
CPC ..... G08G 1/096741; G08G 1/0104; G08G 1/096783; G08G 1/00; G08G 1/01; G01C 21/3492; G01C 21/26
USPC ..... 701/119, 411, 414
See application file for complete search history.

(56) References Cited

U.S. PATENT DOCUMENTS

| | | | |
|---|---|---|---|
| 4,734,863 | A | 3/1988 | Honey et al. |
| 4,788,645 | A | 11/1988 | Zavoli et al. |
| 4,792,803 | A | 12/1988 | Madnick et al. |
| 4,796,191 | A | 1/1989 | Honey et al. |

(Continued)

FOREIGN PATENT DOCUMENTS

| | | |
|---|---|---|
| CA | 2883973 A1 | 8/2013 |
| CO | 6710924 | 7/2013 |

(Continued)

OTHER PUBLICATIONS

US 9,019,260, 04/2015, Gueziec (withdrawn)

(Continued)

*Primary Examiner* — Hussein Elchanti
(74) *Attorney, Agent, or Firm* — Schwegman Lundberg & Woessner, P.A.

(57) ABSTRACT

Systems and methods are provided for estimating time travel distributions on signalized arterials. The systems and methods may be implemented as or through a network service. Traffic data regarding a plurality of travel times on a signalized arterial may be received. A present distribution of the travel times on the signalized arterial may be determined. A prior distribution based on one or more travel time observations may also be determined. The present distribution may be calibrated based on the prior distribution.

23 Claims, 27 Drawing Sheets

(56) References Cited

U.S. PATENT DOCUMENTS 4,878,170 A 10/1989 Zeevi
4,914,605 A 4/1990 Longhmiller, Jr. et al.
4,926,343 A 5/1990 Tsuruta et al.
5,068,656 A 11/1991 Sutherland
5,086,510 A 2/1992 Guenther et al.
5,095,532 A 3/1992 Mardus
5,126,941 A 6/1992 Gurmu et al.
5,164,904 A 11/1992 Sumner
5,173,691 A 12/1992 Sumner
5,182,555 A 1/1993 Sumner
5,220,507 A 6/1993 Kirson
5,247,439 A 9/1993 Gurmu et al.
5,262,775 A 11/1993 Tamai et al.
5,276,785 A 1/1994 Mackinlay et al.
5,283,575 A 2/1994 Kao et al.
5,291,412 A 3/1994 Tamai et al.
5,291,413 A 3/1994 Tamai et al.
5,291,414 A 3/1994 Tamai et al.
5,297,028 A 3/1994 Ishikawa
5,297,049 A 3/1994 Gurmu et al.
5,303,159 A 4/1994 Tamai et al.
5,311,195 A 5/1994 Mathis et al.
5,311,434 A 5/1994 Tamai
5,339,246 A 8/1994 Kao
5,343,400 A 8/1994 Ishikawa
5,345,382 A 9/1994 Kao
5,359,529 A 10/1994 Snider
5,374,933 A 12/1994 Kao
5,377,113 A 12/1994 Shibazaki et al.
5,390,123 A 2/1995 Ishikawa
5,394,333 A 2/1995 Kao
5,402,120 A 3/1995 Fujii et al.
5,414,630 A 5/1995 Oshizawa et al.
5,428,545 A 6/1995 Maegawa et al.
5,430,655 A 7/1995 Adachi
5,440,484 A 8/1995 Kao
5,465,079 A 11/1995 Bouchard et al.
5,477,220 A 12/1995 Ishikawa
5,485,161 A 1/1996 Vaughn
5,488,559 A 1/1996 Seymour
5,499,182 A 3/1996 Ousborne
5,504,482 A 4/1996 Schreder
5,508,931 A 4/1996 Snider
5,515,283 A 5/1996 Desai
5,515,284 A 5/1996 Abe
5,539,645 A 7/1996 Mandhyan et al.
5,546,107 A 8/1996 Deretsky et al.
5,548,822 A 8/1996 Yogo
5,550,538 A 8/1996 Fujii et al.
5,554,845 A 9/1996 Russell
5,583,972 A 12/1996 Miller
5,608,635 A 3/1997 Tamai
5,610,821 A 3/1997 Gazis et al.
5,689,252 A 11/1997 Ayanoglu et al.
5,694,534 A 12/1997 White, Jr. et al.
5,699,056 A 12/1997 Yoshida
5,706,503 A 1/1998 Poppen et al.
5,712,788 A 1/1998 Liaw et al.
5,729,458 A 3/1998 Poppen
5,731,978 A 3/1998 Tamai et al.
5,742,922 A 4/1998 Kim
5,751,245 A 5/1998 Janky et al.
5,751,246 A 5/1998 Hertel
5,757,359 A 5/1998 Morimoto et al.
5,774,827 A 6/1998 Smith et al.
5,818,356 A 10/1998 Schuessler
5,822,712 A 10/1998 Olsson
5,842,142 A 11/1998 Murray et al.
5,845,227 A 12/1998 Peterson
5,850,190 A 12/1998 Wicks et al.
5,862,244 A 1/1999 Kleiner et al.
5,862,509 A 1/1999 Desai et al.
5,864,305 A 1/1999 Rosenquist
5,867,110 A 2/1999 Naito et al.
5,893,081 A 4/1999 Poppen
5,893,898 A 4/1999 Tanimoto
5,898,390 A 4/1999 Oshizawa et al.
5,902,350 A 5/1999 Tamai et al.
5,904,728 A 5/1999 Tamai et al.
5,908,464 A 6/1999 Kishigami et al.
5,910,177 A 6/1999 Zuber
5,911,773 A 6/1999 Mutsuga et al.
5,912,635 A 6/1999 Oshizawa et al.
5,916,299 A 6/1999 Poppen
5,922,042 A 7/1999 Sekine et al.
5,928,307 A 7/1999 Oshizawa et al.
5,931,888 A 8/1999 Hiyokawa
5,933,100 A 8/1999 Golding
5,938,720 A 8/1999 Tamai
5,948,043 A 9/1999 Mathis et al.
5,978,730 A 11/1999 Poppen et al.
5,982,298 A 11/1999 Lappenbusch et al.
5,987,381 A 11/1999 Oshizawa et al.
5,991,687 A 11/1999 Hale et al.
5,999,882 A 12/1999 Simpson et al.
6,009,374 A 12/1999 Urahashi
6,011,494 A 1/2000 Watanabe et al.
6,016,485 A 1/2000 Amakawa et al.
6,021,406 A 2/2000 Kuznetsov
6,038,509 A 3/2000 Poppen et al.
6,058,390 A 5/2000 Liaw et al.
6,064,970 A 5/2000 McMillan et al.
6,091,359 A 7/2000 Geier
6,091,956 A 7/2000 Hollenberg
6,097,399 A 8/2000 Bhatt et al.
6,111,521 A 8/2000 Mulder et al.
6,144,919 A 11/2000 Ceylan et al.
6,147,626 A 11/2000 Sakakibara
6,150,961 A 11/2000 Alewine et al.
6,161,092 A 12/2000 Latshaw et al.
6,169,552 B1 1/2001 Endo et al.
6,188,956 B1 2/2001 Walters
6,209,026 B1 3/2001 Ran et al.
6,222,485 B1 4/2001 Walters et al.
6,226,591 B1 5/2001 Okumura et al.
6,236,933 B1 5/2001 Lang
6,253,146 B1 6/2001 Hanson et al.
6,253,154 B1 6/2001 Oshizawa et al.
6,256,577 B1 7/2001 Granuke
6,259,987 B1 7/2001 Ceylan et al.
6,282,486 B1 8/2001 Bates et al.
6,282,496 B1 8/2001 Chowdhary
6,292,745 B1 9/2001 Robare et al.
6,295,492 B1 9/2001 Lang et al.
6,297,748 B1 10/2001 Lappenbusch et al.
6,298,305 B1 10/2001 Kadaba et al.
6,317,685 B1 11/2001 Kozak et al.
6,317,686 B1 11/2001 Ran
6,335,765 B1 1/2002 Daly et al.
6,353,795 B1 3/2002 Ranjan
6,356,836 B1 3/2002 Adolph
6,360,165 B1 3/2002 Chowdhary
6,360,168 B1 3/2002 Shimbara
6,362,778 B2 3/2002 Neher
6,415,291 B2 7/2002 Bouve et al.
6,424,910 B1 7/2002 Ohler et al.
6,442,615 B1 8/2002 Nordenstam et al.
6,456,931 B1 9/2002 Polidi et al.
6,456,935 B1 9/2002 Ng
6,463,400 B1 10/2002 Barkley-Yeung
6,466,862 B1 10/2002 DeKock et al.
6,470,268 B1 10/2002 Ashcraft et al.
6,473,000 B1 10/2002 Secreet et al.
6,480,783 B1 11/2002 Myr
6,504,541 B1 1/2003 Liu et al.
6,526,335 B1 2/2003 Treyz et al.
6,529,143 B2 3/2003 Mikkola et al.
6,532,304 B1 3/2003 Liu et al.
6,539,302 B1 3/2003 Bender et al.
6,542,814 B2 4/2003 Polidi et al.
6,552,656 B2 4/2003 Polidi et al.
6,556,905 B1 4/2003 Mittlelsteadt et al.
6,559,865 B1 5/2003 Angwin
6,574,548 B2 6/2003 DeKock et al.

(56) References Cited

U.S. PATENT DOCUMENTS 6,584,400 B2 6/2003 Beardsworth
6,594,576 B2 7/2003 Fan et al.
6,598,016 B1 7/2003 Zavoli et al.
6,600,994 B1 7/2003 Polidi
6,603,405 B2 8/2003 Smith
6,622,086 B2 9/2003 Polidi
6,639,550 B2 10/2003 Knockheart et al.
6,643,581 B2 * 11/2003 Ooishi ..... 701/516
6,650,948 B1 11/2003 Atkinson et al.
6,650,997 B2 11/2003 Funk
6,654,681 B1 11/2003 Kiendl et al.
6,675,085 B2 1/2004 Straub
6,681,176 B2 1/2004 Funk et al.
6,687,615 B1 2/2004 Krull et al.
6,700,503 B2 3/2004 Masar et al.
6,710,774 B1 3/2004 Kawasaki et al.
6,720,889 B2 4/2004 Yamaki et al.
6,728,605 B2 4/2004 Lash et al.
6,728,628 B2 4/2004 Peterson
6,731,940 B1 5/2004 Nagendran
6,735,516 B1 5/2004 Manson
6,754,833 B1 6/2004 Black et al.
6,785,606 B2 8/2004 DeKock et al.
6,791,472 B1 9/2004 Hoffberg
6,807,483 B1 10/2004 Chao et al.
6,845,316 B2 1/2005 Yates
6,859,728 B2 2/2005 Sakamoto et al.
6,862,524 B1 3/2005 Nagda et al.
RE38,724 E 4/2005 Peterson
6,885,937 B1 4/2005 Sunranyi
6,901,330 B1 5/2005 Krull et al.
6,914,541 B1 7/2005 Zierden
6,922,629 B2 7/2005 Yoshikawa et al.
6,931,309 B2 8/2005 Phelan et al.
6,952,643 B2 10/2005 Matsuoka et al.
6,965,665 B2 11/2005 Fan et al.
6,983,204 B2 1/2006 Knutson
6,987,964 B2 1/2006 Obradovich et al.
6,989,765 B2 1/2006 Gueziec
6,999,873 B1 2/2006 Krull et al.
7,010,583 B1 3/2006 Aizono et al.
7,062,378 B2 6/2006 Krull et al.
7,069,143 B2 6/2006 Peterson
7,103,854 B2 9/2006 Fuchs et al.
7,161,497 B2 1/2007 Gueziec
7,209,828 B2 4/2007 Katou
7,221,287 B2 5/2007 Gueziec
7,243,134 B2 7/2007 Bruner et al.
7,343,242 B2 * 3/2008 Breitenberger et al. ..... 701/117
7,356,392 B2 4/2008 Hubbard et al.
7,375,649 B2 5/2008 Gueziec
7,424,388 B2 9/2008 Sato
7,433,676 B2 * 10/2008 Kobayashi et al. ..... 455/408
7,440,842 B1 * 10/2008 Vorona ..... 701/117
7,486,201 B2 2/2009 Kelly et al.
7,508,321 B2 3/2009 Gueziec
7,557,730 B2 7/2009 Gueziec
7,558,674 B1 7/2009 Neiley et al.
7,603,138 B2 * 10/2009 Zhang et al. ..... 455/556.1
7,610,145 B2 10/2009 Kantarjiev et al.
7,613,564 B2 * 11/2009 Vorona ..... 701/117
7,634,352 B2 12/2009 Soulchin et al.
7,702,452 B2 4/2010 Kantarjiev et al.
7,792,642 B1 9/2010 Neiley et al.
7,835,858 B2 11/2010 Smyth et al.
7,847,708 B1 12/2010 Jones et al.
7,880,642 B2 2/2011 Gueziec
7,908,076 B2 * 3/2011 Downs et al. ..... 701/117
7,912,627 B2 * 3/2011 Downs et al. ..... 701/117
8,024,111 B1 9/2011 Meadows et al.
8,103,443 B2 1/2012 Kantarjiev et al.
8,229,658 B1 7/2012 Dabell
8,358,222 B2 1/2013 Gueziec
8,428,856 B2 4/2013 Tischer
8,531,312 B2 9/2013 Gueziec
8,537,033 B2 9/2013 Gueziec
8,564,455 B2 10/2013 Gueziec
8,618,954 B2 12/2013 Free
8,619,072 B2 12/2013 Gueziec
8,660,780 B2 2/2014 Kantarjiev
8,718,910 B2 5/2014 Gueziec
8,725,396 B2 5/2014 Gueziec
8,781,718 B2 * 7/2014 Margulici et al. ..... 701/119
8,786,464 B2 7/2014 Gueziec
8,825,356 B2 9/2014 Vorona
8,958,988 B2 2/2015 Gueziec
8,965,695 B2 2/2015 Tzamaloukas
8,972,171 B1 3/2015 Barth
8,982,116 B2 3/2015 Gueziec
9,002,636 B2 4/2015 Udeshi et al.
9,046,924 B2 6/2015 Gueziec
9,070,291 B2 6/2015 Gueziec
9,082,303 B2 7/2015 Gueziec
9,127,959 B2 9/2015 Kantarjiev
9,158,980 B1 10/2015 Ferguson et al.
9,293,039 B2 3/2016 Margulici
9,368,029 B2 6/2016 Gueziec
9,390,620 B2 7/2016 Gueziec
9,401,088 B2 7/2016 Gueziec
9,448,690 B2 9/2016 Gueziec
9,489,842 B2 11/2016 Gueziec
2001/0005809 A1 6/2001 Ito
2001/0014848 A1 8/2001 Walgers et al.
2001/0018628 A1 8/2001 Jenkins et al.
2001/0026276 A1 10/2001 Sakamoto et al.
2001/0033225 A1 10/2001 Razavi et al.
2001/0047242 A1 11/2001 Ohta
2001/0049424 A1 12/2001 Petiniot et al.
2002/0022923 A1 2/2002 Hirabayashi et al.
2002/0042819 A1 4/2002 Reichert et al.
2002/0077748 A1 6/2002 Nakano
2002/0152020 A1 10/2002 Seibel
2002/0177947 A1 11/2002 Cayford
2003/0009277 A1 1/2003 Fan et al.
2003/0046158 A1 3/2003 Kratky
2003/0055558 A1 3/2003 Watanabe et al.
2003/0109985 A1 6/2003 Kotzin
2003/0135304 A1 7/2003 Sroub et al.
2003/0151592 A1 8/2003 Ritter
2003/0182052 A1 9/2003 DeLorme et al.
2004/0034464 A1 2/2004 Yoshikawa et al.
2004/0046759 A1 3/2004 Soulchin et al.
2004/0049424 A1 3/2004 Murray et al.
2004/0080624 A1 4/2004 Yuen
2004/0107288 A1 6/2004 Menninger et al.
2004/0143385 A1 7/2004 Smyth et al.
2004/0166939 A1 8/2004 Leifer et al.
2004/0225437 A1 11/2004 Endo et al.
2004/0249568 A1 12/2004 Endo et al.
2005/0021225 A1 1/2005 Kantarjiev et al.
2005/0027436 A1 2/2005 Yoshikawa et al.
2005/0083325 A1 4/2005 Cho
2005/0099321 A1 5/2005 Pearce
2005/0143902 A1 6/2005 Soulchin et al.
2005/0154505 A1 7/2005 Nakamura et al.
2005/0212756 A1 9/2005 Marvit et al.
2005/0240340 A1 10/2005 Ishikawa et al.
2006/0074546 A1 4/2006 DeKock et al.
2006/0122846 A1 6/2006 Burr et al.
2006/0136846 A1 6/2006 Im et al.
2006/0143959 A1 7/2006 Stehle et al.
2006/0145892 A1 7/2006 Gueziec
2006/0158330 A1 7/2006 Gueziec
2006/0238521 A1 10/2006 Westerman et al.
2006/0238617 A1 10/2006 Tamir
2006/0284766 A1 12/2006 Gruchala et al.
2007/0009156 A1 1/2007 O'Hara
2007/0013551 A1 1/2007 Gueziec
2007/0038362 A1 2/2007 Gueziec
2007/0060384 A1 3/2007 Dohta
2007/0066394 A1 3/2007 Ikeda et al.
2007/0115252 A1 5/2007 Burgmans
2007/0142995 A1 6/2007 Wottlermann
2007/0197217 A1 8/2007 Sutardja

(56) References Cited

U.S. PATENT DOCUMENTS

| | | | |
|---|---|---|---|
| 2007/0208494 | A1 | 9/2007 | Chapman et al. |
| 2007/0208495 | A1 | 9/2007 | Chapman et al. |
| 2007/0208496 | A1 | 9/2007 | Downs et al. |
| 2007/0211026 | A1 | 9/2007 | Ohta |
| 2007/0211027 | A1 | 9/2007 | Ohta |
| 2007/0222750 | A1 | 9/2007 | Ohta |
| 2007/0247291 | A1 | 10/2007 | Masuda et al. |
| 2007/0265766 | A1 | 11/2007 | Jung et al. |
| 2008/0014908 | A1 | 1/2008 | Vasant |
| 2008/0021632 | A1 | 1/2008 | Amano |
| 2008/0071465 | A1 | 3/2008 | Chapman et al. |
| 2008/0084385 | A1 | 4/2008 | Ranta et al. |
| 2008/0096654 | A1 | 4/2008 | Mondesir et al. |
| 2008/0133120 | A1 | 6/2008 | Romanick |
| 2008/0248848 | A1 | 10/2008 | Rippy et al. |
| 2008/0255754 | A1 | 10/2008 | Pinto |
| 2008/0287189 | A1 | 11/2008 | Rabin |
| 2008/0297488 | A1 | 12/2008 | Operowsky et al. |
| 2009/0005965 | A1 | 1/2009 | Forstall et al. |
| 2009/0061971 | A1 | 3/2009 | Weitzner et al. |
| 2009/0066495 | A1 | 3/2009 | Newhouse et al. |
| 2009/0082950 | A1 | 3/2009 | Vorona |
| 2009/0096753 | A1 | 4/2009 | Lim |
| 2009/0112465 | A1 | 4/2009 | Weiss et al. |
| 2009/0118017 | A1 | 5/2009 | Perlman et al. |
| 2009/0118996 | A1 | 5/2009 | Kantarjiev et al. |
| 2009/0189979 | A1 | 7/2009 | Smyth |
| 2009/0192702 | A1 | 7/2009 | Bourne |
| 2009/0254272 | A1 | 10/2009 | Hendrey |
| 2010/0036594 | A1 | 2/2010 | Yamane |
| 2010/0045517 | A1 | 2/2010 | Tucker |
| 2010/0079306 | A1 | 4/2010 | Liu et al. |
| 2010/0094531 | A1 | 4/2010 | MacLeod |
| 2010/0100307 | A1 | 4/2010 | Kim |
| 2010/0145569 | A1 | 6/2010 | Bourque et al. |
| 2010/0145608 | A1 | 6/2010 | Kurtti et al. |
| 2010/0164753 | A1 | 7/2010 | Free |
| 2010/0175006 | A1 | 7/2010 | Li |
| 2010/0194632 | A1 | 8/2010 | Raento et al. |
| 2010/0198453 | A1 | 8/2010 | Dorogusker et al. |
| 2010/0225643 | A1 | 9/2010 | Gueziec |
| 2010/0305839 | A1 | 12/2010 | Wenzel |
| 2010/0312462 | A1 | 12/2010 | Gueziec |
| 2010/0333045 | A1 | 12/2010 | Gueziec |
| 2011/0029189 | A1 | 2/2011 | Hyde et al. |
| 2011/0037619 | A1 | 2/2011 | Ginsberg et al. |
| 2011/0106427 | A1 | 5/2011 | Kim et al. |
| 2011/0161261 | A1 | 6/2011 | Wu et al. |
| 2011/0304447 | A1 | 12/2011 | Marumoto |
| 2012/0044066 | A1 | 2/2012 | Mauderer et al. |
| 2012/0065871 | A1 | 3/2012 | Deshpande et al. |
| 2012/0072096 | A1 | 3/2012 | Chapman et al. |
| 2012/0123667 | A1 | 5/2012 | Gueziec |
| 2012/0150422 | A1 | 6/2012 | Kantarjiev et al. |
| 2012/0150425 | A1 | 6/2012 | Chapman et al. |
| 2012/0158275 | A1 | 6/2012 | Huang et al. |
| 2012/0226434 | A1 | 9/2012 | Chiu |
| 2012/0290202 | A1 | 11/2012 | Gueziec |
| 2012/0290204 | A1 | 11/2012 | Gueziec |
| 2012/0296559 | A1 | 11/2012 | Gueziec |
| 2013/0033385 | A1 | 2/2013 | Gueziec |
| 2013/0204514 | A1 | 8/2013 | Margulici |
| 2013/0207817 | A1 | 8/2013 | Gueziec |
| 2013/0211701 | A1 | 8/2013 | Baker et al. |
| 2013/0297175 | A1 | 11/2013 | Davidson |
| 2013/0304347 | A1 | 11/2013 | Davidson |
| 2013/0304349 | A1 | 11/2013 | Davidson |
| 2014/0088871 | A1 | 3/2014 | Gueziec |
| 2014/0091950 | A1 | 4/2014 | Gueziec |
| 2014/0107923 | A1 | 4/2014 | Gueziec |
| 2014/0129142 | A1 | 5/2014 | Kantarjiev |
| 2014/0139520 | A1 | 5/2014 | Gueziec |
| 2014/0200807 | A1 | 7/2014 | Geisberger |
| 2014/0236464 | A1 | 8/2014 | Gueziec |
| 2014/0249734 | A1 | 9/2014 | Gueziec |
| 2014/0316688 | A1 | 10/2014 | Margulici |
| 2014/0320315 | A1 | 10/2014 | Gueziec |
| 2015/0081196 | A1 | 3/2015 | Petty et al. |
| 2015/0141043 | A1 | 5/2015 | Abramson et al. |
| 2015/0168174 | A1 | 6/2015 | Abramson et al. |
| 2015/0168175 | A1 | 6/2015 | Abramson et al. |
| 2015/0177018 | A1 | 6/2015 | Gueziec |
| 2015/0248795 | A1 | 9/2015 | Davidson |
| 2015/0261308 | A1 | 9/2015 | Gueziec |
| 2015/0268055 | A1 | 9/2015 | Gueziec |
| 2015/0268056 | A1 | 9/2015 | Gueziec |
| 2015/0325123 | A1 | 11/2015 | Gueziec |
| 2016/0047667 | A1 | 2/2016 | Kantarjiev |
| 2016/0267788 | A1 | 9/2016 | Margulici et al. |
| 2016/0302047 | A1 | 10/2016 | Gueziec |
| 2016/0321918 | A1 | 11/2016 | Gueziec |
| 2016/0335893 | A1 | 11/2016 | Gueziec |

FOREIGN PATENT DOCUMENTS

| | | |
|---|---|---|
| DE | 19856704 | 6/2001 |
| EP | 0 680 648 | 11/1995 |
| EP | 0 749 103 | 12/1996 |
| EP | 0 987 665 | 3/2000 |
| EP | 1 006 367 | 6/2000 |
| EP | 1 235 195 | 8/2002 |
| EP | 2 178 061 | 4/2010 |
| EP | 2 635 989 | 9/2011 |
| EP | 2 616 910 | 7/2013 |
| EP | 2 638 493 | 9/2013 |
| EP | 2 710 571 | 3/2014 |
| EP | 2 820 631 | 1/2015 |
| GB | 2 400 293 | 10/2004 |
| JP | 05-313578 | 11/1993 |
| JP | 08-77485 | 3/1996 |
| JP | 10-261188 | 9/1998 |
| JP | 10-281782 | 10/1998 |
| JP | 10-293533 | 11/1998 |
| JP | 2000-055675 | 2/2000 |
| JP | 2000-113387 | 4/2000 |
| JP | 2001-330451 | 11/2001 |
| WO | WO 1996/036929 | 11/1996 |
| WO | WO-9636929 A1 | 11/1996 |
| WO | WO 98/23018 | 5/1998 |
| WO | WO 00/50917 | 8/2000 |
| WO | WO 01/88480 | 11/2001 |
| WO | WO 02/77921 | 10/2002 |
| WO | WO 03/014671 | 2/2003 |
| WO | WO 2005/013063 | 2/2005 |
| WO | WO 2005/076031 | 8/2005 |
| WO | WO 2010/073053 | 7/2010 |
| WO | WO 2012/024694 | 2/2012 |
| WO | WO 2012/037287 | 3/2012 |
| WO | WO 2012/065188 | 5/2012 |
| WO | WO 2012/159083 | 11/2012 |
| WO | WO-2012037287 | 3/2013 |
| WO | WO 2013/113029 | 8/2013 |

OTHER PUBLICATIONS

U.S. Appl. No. 14/265,290, Andre Gueziec, Crowd Sourced Traffic Reporting, filed Apr. 29, 2014.

U.S. Appl. No. 14/275,702, Andre Gueziec, System for Providing Traffic Data and Driving Efficiency Data, filed May 12, 2014.

U.S. Appl. No. 12/860,700, Office Action dated Apr. 3, 2014.

U.S. Appl. No. 14/100,985, Andre Gueziec, Controlling a Three-Dimensional Virtual Broadcast Presentation, filed Dec. 2013.

U.S. Appl. No. 14/155,174, Christoher Kantarjiev, System and Method for Delivering Departure Notifications, filed Jan. 14, 2014.

U.S. Appl. No. 14/029,617, Andre Gueziec, Generating Visual Information Associated With Traffic, filed Sep. 17, 2013.

U.S. Appl. No. 14/022,224, Andre Gueziec, Method for Choosing a Traffic Route, filed Sep. 2013.

U.S. Appl. No. 14/029,621, Andre Gueziec, Method for Predicting a Travel Time for a Traffic Route, filed Sep. 17, 2013.

U.S. Appl. No. 12/860,700, Final Office Action dated Jul. 22, 2014.

(56) References Cited

OTHER PUBLICATIONS

Huang, Tsan-Huang, Chen, Wu-Cheng; "Experimental Analysis and Modeling of Route Choice with the Revealed and Stated Preference Data" Journal of the Eastern Asia Society for Transportation Studies, vol. 3, No. 6, Sep. 1999—Traffic Flow and Assignment.
U.S. Appl. No. 14/323,352, Office Action dated Nov. 26, 2014.
Yang, Qi; "A Simulation Laboratory for Evaluation of Dynamic Traffic Management Systems", Massachusetts Institute of Technology, Jun. 1997.
U.S. Appl. No. 12/881,690, Office Action dated Sep. 3, 2014.
U.S. Appl. No. 14/100,985, Office Action dated Sep. 23, 2014.
U.S. Appl. No. 14/624,498, Andre Gueziec, Method for Choosing a Traffic Route, filed Feb. 17, 2015.
U.S. Appl. No. 14/637,357, Andre Gueziec, Touch Screen Based Interaction With Traffic Data, filed Mar. 3, 2015.
U.S. Appl. No. 14/100,985, Final Office Action dated Mar. 25, 2015.
U.S. Appl. No. 14/327,468, Office Action dated Mar. 12, 2015.
U.S. Appl. No. 14/323,352, Final Office Action dated Apr. 3, 2015.
U.S. Appl. No. 14/692,097, Andre Gueziec, Method for Predicting a Travel Time for a Traffic Route, filed Apr. 21, 2015.
EP Patent Application No. 12785688.8 Extended European Search Report dated Aug. 12, 2015.
U.S. Appl. No. 14/275,702, Office Action dated Nov. 30, 2015.
U.S. Appl. No. 14/265,290, Office Action dated Jul. 23, 2015.
U.S. Appl. No. 14/327,468, Final Office Action dated Aug. 4, 2015.
U.S. Appl. No. 14/100,985, Office Action dated Oct. 1, 2015.
U.S. Appl. No. 15/077,880, Office Action dated Jul. 21, 2016.
U.S. Appl. No. 15/181,221 Office Action dated Aug. 26, 2011.
U.S. Appl. No. 14/637,357, Office Action dated Aug. 23, 2016.
U.S. Appl. No. 14/726,858 Final Office Action dated Sep. 8, 2016.
Canada Patent Application No. 2,688,129 Office Action dated Jan. 18, 2016.
"European Application Serial No. 13740931.4, Response filed May 11, 2015 to Communication pursuant to Rules 161(2) and 162 EPC dated Feb. 24, 2015", 6 pgs.
"European Application Serial No. 13740931.4, Response filed Nov. 7, 2016 to Extended European Search Report dated Apr. 19, 2016", 21 pgs.
U.S. Appl. No. 14/265,290, Office Action dated May 31, 2016.
U.S. Appl. No. 14/265,290, Final Office Action dated Jan. 29, 2016.
U.S. Appl. No. 14/624,498, Office Action dated Feb. 18, 2016.
U.S. Appl. No. 14/726,858 Office Action dated Feb. 22, 2016.
U.S. Appl. No. 15/077,880, J.D. Margulici, Estimating Time Travel Distributions on Signalized Arterials, filed Mar. 22, 2016.
U.S. Appl. No. 15/270,916, Andre Gueziec, Controlling a Three-Dimensional Virtual Broadcast Presentation.
U.S. Appl. No. 15/181,221, Andre Gueziec, GPS Generated Traffic Information, filed Jun. 13, 2016.
U.S. Appl. No. 15/207,377, Andre Gueziec, System for Providing Traffic Data and Driving Efficiency Data.
U.S. Appl. No. 15/218,619, Andre Gueziec, Method for Predicting a Travel Time for a Traffic Route.
"U.S. Appl. No. 13/752,351, Notice of Allowance dated Feb. 21, 2014", 5 pgs.
"U.S. Appl. No. 13/752,351, Notice of Allowance dated May 27, 2014", 2 pgs.
"U.S. Appl. No. 13/752,351, Notice of Allowance dated Nov. 12, 2013", 7 pgs.
"U.S. Appl. No. 13/752,351, Response filed Oct. 22, 2013 to Non Final Office Action dated Jul. 22, 2013", 6 pgs.
"U.S. Appl. No. 14/323,352, Notice of Allowance dated Nov. 13, 2015", 6 pgs.
"U.S. Appl. No. 14/323,352, Response filed Feb. 26, 2015 to Non Final Office Action dated Nov. 26, 2014", 3 pgs.
"U.S. Appl. No. 14/323,352, Response filed Oct. 2, 2015 to Final Office Action dated Apr. 3, 2015", 3 pgs.
"U.S. Appl. No. 14/323,352, Supplemental Notice of Allowability dated Feb. 3, 2016", 2 pgs.
"U.S. Appl. No. 14/323,352, Supplemental Notice of Allowability dated Dec. 8, 2015", 2 pgs.
"U.S. Appl. No. 15/077,880, Notice of Non-Compliant Amendment dated Feb. 2, 2017", 6 pgs.
"U.S. Appl. No. 15/077,880, Preliminary Amendment filed Jun. 2, 2016", 6 pgs.
"U.S. Appl. No. 15/077,880, Response filed Dec. 21, 2016 to Non Final Office Action dated Jul. 21, 2016", 9 pgs.
"European Application Serial No. 11825897.9, Communication dated May 3, 2013", 2 pgs.
"European Application Serial No. 13740931.4, Extended European Search Report dated Apr. 19, 2016", 9 pgs.
"International Application Serial No. PCT/US2013/023505, International Preliminary Report on Patentability dated Aug. 7, 2014", 5 pgs.
"International Application Serial No. PCT/US2013/023505, International Search Report dated May 10, 2013", 2 pgs.
"International Application Serial No. PCT/US2013/023505, Written Opinion dated May 10, 2013", 3 pgs.
Benjamin, Coifman, "Improved Vehicle Reidentification and Travel Time Measurement on Congested Freeways", Journal of Transportation Engineering (Oct. 1, 1999), 475-483.
U.S. Appl. No. 14/265,290, Final Office Action dated Oct. 19, 2016.
Coifman, Benjamin; "Vehicle Reidentification and Travel Time Measurement on Congested Freeeways", Journal of Transportation Engineering, Oct. 1, 1999; pp. 475-483.
EP Patent Application No. 1740931.4 Extended European Search Report dated Apr. 19, 2016.
Acura Debuts AcuraLink™ Satellite-Linked Communication System with Industry's First Standard Real Time Traffic Feature at New York International Auto Show, 2004, 4 pages.
Adib Kanafani, "Towards a Technology Assessment of Highway Navigation and Route Guidance," Program on Advanced Technology for the Highway, Institute of Transportation Studies, University of California, Berkeley, Dec. 1987, PATH Working Paper UCB-ITS-PWP-87-6.
Answer, Affirmative Defenses, and Counterclaims by Defendant Westwood One, Inc., to Plaintiff Triangle Software, LLC's Complaint for Patent Infringement, Mar. 11, 2011.
Answer and Counterclaims of TomTom, Inc. to Plaintiff Triangle Software, LLC's Complaint for Patent Infringement, May 16, 2011.
Amended Answer and Counterclaims of TomTom, Inc. to Plaintiff Triangle Software, LLC's Complaint for Patent Infringement, Mar. 16, 2011.
Attachment A of Garmin's Preliminary Invalidity Contentions and Certificate of Service filed May 16, 2011 in *Triangle Software, LLC. V. Garmin International, Inc. et al.*, Case No. 1: 10-cv-1457-CMH-TCB in the United States District Court for the Eastern District of Virginia, Alexandria Division, 6 pages.
Attachment B of Garmin's Preliminary Invalidity Contentions and Certificate of Service filed May 16, 2011 in *Triangle Software, LLC. V. Garmin International, Inc. et al.*, Case No. 1: 10-cv-1457-CMH-TCB in the United States District Court for the Eastern District of Virginia, Alexandria Division, 618 pages.
Audi-V150 Manual, Oct. 2001, 152 pages, Japan.
Balke, K.N., "Advanced Technologies for Communicating with Motorists: A Synthesis of Human Factors and Traffic Management Issues," Report No. FHWA/TX-92/1232-8, May 1992, Texas Department Transportation, Austin, TX, USA, 62 pages.
Barnaby J. Feder, "Talking Deals; Big Partners in Technology," Technology, The New York Times, Sep. 3, 1987.
Birdview Navigation System by Nissan Motor Corp, 240 Landmarks of Japanese Automotive Technology, 1995, 2 pages, Society of Automotive Engineers of Japan, Inc., Japan.
Blumentritt, K. et al., "Travel System Architecture Evaluation," Publication No. FHWA-RD-96-141, Jul. 1995, 504 pages, U.S. Department of Transportation, McLean, VA, USA.
Brooks, et al., "Turn-by-Turn Displays versus Electronic Maps: An On-the-Road Comparison of Driver Glance Behavior," Technical Report, The University of Michigan, Transportation Research Institute (UMTRI), Jan. 1999.
Burgett, A.L., "Safety Evaluation of TravTek," Vehicle Navigation & Information Systems Conference Proceedings (VNIS'91), P-253, Part 1, Oct. 1991, pp. 819-825, Soc. Of Automotive Engineers, Inc., Warrendale, PA, USA.

(56) References Cited

OTHER PUBLICATIONS

Campbell, J.L. "Development of Human Factors Design Guidelines for Advanced Traveler Information Systems (ATIS)", Proceedings Vehicle Navigation and Information Systems Conference, 1995, pp. 161-164, IEEE, New York, NY, USA.
Campbell, J.L. "Development of Human Factors Design Guidelines for Advanced Traveler Information Systems (ATIS) and Commercial Vehicle Operations (CVO)", Publication No. FHWA-RD-98-057, Report Date Sep. 1998, 294, pages, U.S. Department of Transportation, McLean, VA 22010-2296.
Cathey, F.W. et al., "A Prescription for Transit Arrival/Department Prediction Using Automatic Vehicle Location Data," Transportation Research Part C 11, 2003, pp. 241-264, Pergamon Press Ltd., Elsevier Ltd., U.K.
Chien, S.I. et al., "Predicting Travel Times for the South Jersey Real-Time Motorist Information System," Transportation Research Record 1855, Paper No. Mar. 2750, Revised Oct. 2001, pp. 32-40.
Chira-Chavala, T. et al., "Feasibility Study of Advanced Technology HOV Systems," vol. 3: Benefit Implications of Alternative Policies for Including HOV lanes in Route Guidance Networks, Dec. 1992, 84 ages, UCB-ITS-PRR-92-5 PATH Research Report, Inst. of Transportation Studies, Univ. of Calif., Berkeley, USA.
Clark, E.L., Development of Human Factors Guidelines for Advanced Traveler Information Systems (ATIS) and Commercial Vehicle Operations (CVO): Comparable Systems Analysis, Dec. 1996, 199 pages.
Dancer, F. et al., "Vehicle Navigation Systems: Is America Ready?," Navigation and Intelligent Transportation System, Automotive Electronics Series, Society of Automotive Engineers, 1998, pp. Cover page, Table of Contents pp. 3-8.
Davies, P. et al., "Assessment of Advanced Technologies for Relieving Urban Traffic Congestion" National Cooperative Highway Research Program Report 340, Dec. 1991, 106 pages.
de Cambray, B. "Three-Dimensional (3D) Modeling in a Geographical Database," Auto-Carto'11, Eleventh International Conference on Computer Assisted Cartography, Oct. 30, 1993-Nov. 1, 1993, pp. 338-347, Minneapolis, USA.
Declaration Under 37 C.F.R. 1.131 and Source Code from U.S. Appl. No. 10/897,550, filed Oct. 27, 2008.
Dillenburg, J.F. et al., "The Intelligent Travel Assistant," IEEE 5th International Conference on Intelligent Transportation Systems, Sep. 3-6, 2002, pp. 691-696, Singapore.
Dingus, T.A. et al., "Human Factors Engineering the TravTek Driver Interface," Vehicle Navigation & Information System Conference Proceedings (VNIS'91), P-253, Part 2, Oct. 1991, pp. 749-755, Soc. Of Automotive Engineers, Inc., Warrendale, PA, USA.
Endo, et al., "Development and Evaluation of a Car Navigation System Providing a Birds Eye View Map Display," Navigation and Intelligent Transportation Systems, Automotive Electronics Series, Society of Automotive Engineers, 1998, pp. Cover page, Table of Contents, pp. 19-22.
Eppinger, A. et al., "Dynamic Route Guidance—Status and Trends," Convergence 2000 International Congress on Transportation Electronics, Oct. 16-18, 1999, 7 pages, held in Detroit, MI, SAE International Paper Series, Warrendale, PA, USA.
Expert Report of Dr. Michael Goodchild Concerning the Validity of U.S. Pat. No. 5,938,720 dated Jun. 16, 2011 in *Triangle Software, LLC* v. *Garmin International Inc. et al.*, in the United States District Court for the Eastern District of Virginia, Alexandria Division, Case No. 1:10-cv-1457-CMH-TCB, 16 pages.
Fawcett, J., "Adaptive Routing for Road Traffic," IEEE Computer Graphics and Applications, May/Jun. 2000, pp. 46-53, IEEE, New York, NY, USA.
Fleischman, R.N., "Research and Evaluation Plans for the TravTek IVHS Operational Field Test," Vehicle Navigation & Information Systems Conference Proceedings (VNIS'91), P253, Part 2, Oct. 1991, pp. 827-837, Soc. of Automotive Engineers, Inc., Warrendale, PA, USA.
Garmin International, Inc.'s Answer and Counterclaims to Triangle Software, LLC's Complaint, Feb. 24, 2011.
Garmin International, Inc.'s Amended Answer and Counterclaims to Triangle Software, LLC's Complaint, Mar. 16, 2011.
Garmin International, Inc. and Garmin USA, Inc.'s Answer and Counterclaim to Triangle Software, LLC's Supplemental Complaints filed Jun. 17, 2011 in *Triangle Software, LLC* v. *Garmin International Inc. et al.*, in the United States District Court for the Eastern District of Virginia, Alexandria Division, Case No. 1:10-cv-1457-CMH-TCB, 36 pages.
Garmin's Preliminary Invalidity Contentions and Certificate of Service filed May 16, 2011 in *Triangle Software, LLC*. V. *Garmin International, Inc. et al.*, Case No. 1: 10-cv-1457-CMH-TCB in the United States District Court for the Eastern District of Virginia, Alexandria Division, 46 pages.
Goldberg et al., "Computing the Shortest Path: A* Search Meets Graph Theory," Proc. of the 16th Annual ACM-SIAM Sym. on Discrete Algorithms, Jan. 23-25, 2005. Vancouver, BC.
Goldberg et al., "Computing the Shortest Path: A* Search Meets Graph Theory," Microsoft Research, Technical Report MSR-TR-2004 Mar. 24, 2003.
Golisch, F., Navigation and Telematics in Japan, International Symposium On Car Navigation Systems, May 21, 1997, 20 pages, held in Barcelona, Spain.
GM Exhibits Prototype of TravTek Test Vehicle, Inside IVHS, Oct. 28, 1991, V. 1, No. 21, 2 pages.
Gueziec, Andre, "3D Traffic Visualization in Real Time," ACM Siggraph Technical Sketches, Conference Abstracts and Applications, p. 144, Los Angeles, CA, Aug. 2001.
Gueziec, A., "Architecture of a System for Producing Animated Traffic Reports," Mar. 30, 2011, 42 pages.
Handley, S. et al., "Learning to Predict the Duration of an Automobile Trip," Proceedings of the Fourth International Conference on Knowledge Discovery and Data Mining, 1998, 5 pages, AAAI Press, New York, NY, USA.
Hankey, et al., "In-Vehicle Information Systems Behavioral Model and Design Support: Final Report," Feb. 16, 2000, Publication No. 00-135, Research, Development, and Technology, Turner-Fairbank Highway Research Center, McLean, Virginia.
Hirata et al., "The Development of a New Multi-AV System Incorporating an On-Board Navigation Function," International Congress and Exposition, Mar. 1-5, 1993, pp. 1-12, held in Detroit, MI, SAE International, Warrendale, PA, USA.
Hoffmann, G. et al., Travel Times as a Basic Part of the LISB Guidance Strategy, Third International Conference on Road Traffic Control, May 1-3, 1990, pp. 6-10, London, U.K.
Hoffmann, T., "2005 Acura RL Prototype Preview," Auto123.com, 4 pages.
Hu, Z. et al., "Real-time Data Fusion on Tracking Camera Pose for Direct Visual Guidance," IEEE Vehicles Symposium, Jun. 14-17, 2004, pp. 842-847, held in Parma, Italy.
Hulse, M.C. et al., "Development of Human Factors Guidelines for Advanced Traveler Information Systems and Commercial Vehicle Operations: Identification of the Strengths and Weaknesses of Alternative Information Display Formats," Publication No. FHWA-RD-96-142, Oct. 16, 1998, 187 pages, Office of Safety and Traffic Operation R&D, Federal Highway Administration, USA.
Initial Expert Report of Roy Summer dated Jun. 16, 2011 in *Triangle Software, LLC* v. *Garmin International Inc. et al.*, in the United States District Court for the Eastern District of Virginia, Alexandria Division, Case No. 1:10-cv-1457-CMH-TCB, 289 pages.
Initial Expert Report of William R. Michalson, Ph.D. dated Jun. 17, 2011 in *Triangle Software, LLC* v. *Garmin International Inc. et al.*, in the United States District Court for the Eastern District of Virginia, Alexandria Division, Case No. 1:10-cv-1457-CMH-TCB, 198 pages.
Inman, V.W., et al., "TravTek Global Evaluation and Executive Summary," Publication No. FHWA-RD-96-031, Mar. 1996, 104 pages, U.S. Department of Transportation, McLean, VA, USA.
Inman, V.W., et al., "TravTek Evaluation Rental and Local User Study," Publication No. FHWA-RD-96-028, Mar. 1996, 110 pages, U.S. Department of Transportation, McLean, VA, USA.
Jiang, G., "Travel-Time Prediction for Urban Arterial Road: A Case on China," Proceedings Intelligent Transportation Systems, Oct. 12-15, 2003, pp. 255-260, IEEE, New York, NY, USA.

(56) References Cited

OTHER PUBLICATIONS

Karabassi, A. et al., "Vehicle Route Prediction and Time and Arrival Estimation Techniques for Improved Transportation System Management," in Proceedings of the Intelligent Vehicles Symposium, 2003, pp. 511-516, IEEE, New York, NY, USA.
Koller, D. et al., "VIRTUAL GIS: A Real-Time 3D Geographic Information System," Proceedings of the 6th IEEE Visualization Conference (Visualization 95) 1995, pp. 94-100, IEEE, New York, NY, USA.
Kopitz et al., Table of Contents, Chapter 6, Traffic Information Services, and Chapter 7, Intelligent Transport Systems and RDS-TMC in RDS: The Radio Data System, 1992, Cover page-XV, pp. 107-167, Back Cover page, Artech House Publishers, Boston, USA and London, Great Britain.
Krage, M.K., "The TravTek Driver Information System," Vehicle Navigation & Information Systems Conference Proceedings (VNIS'91), P-253, Part 1, Oct. 1991, pp. 739-748, Soc. Of Automotive Engineers, Inc., Warrendale, PA, USA.
Ladner, R. et al., "3D Mapping of Interactive Synthetic Environment," Computing Practices, Mar. 2000, pp. 33-39, IEEE, New York, NY, USA.
Levinson, D., "Assessing the Benefits and Costs of Intelligent Transportation Systems: The Value of Advanced Traveler Information System," Publication UCB-ITS-PRR-99-20, California Path Program, Jul. 1999, Institute of Transportation Studies, University of California, Berkeley, CA, USA.
Lowenau, J., "Final Map Actualisation Requirements," Version 1.1, ActMAP Consortium, Sep. 30, 2004, 111 pages.
Meridian Series of GPS Receivers User Manual, Magellan, 2002, 106 pages, Thales Navigation, Inc., San Dimas, CA, USA.
Ness, M., "A Prototype Low Cost In-Vehicle Navigation System," IEEE-IEE Vehicle Navigation & Information Systems Conference (VNIS), 1993, pp. 56-59, New York, NY, USA.
Nintendo Wii Operations Manual Systems Setup. 2009.
Noonan, J., "Intelligent Transportation Systems Field Operational Test Cross-Cutting Study Advanced Traveler Information Systems," Sep. 1998, 27 pages, U.S. Department of Transportation, McLean, VA, USA.
Odagaki et al., Automobile Navigation System with Multi-Source Guide Information, International Congress & Exposition, Feb. 24-28, 1992, pp. 97-105. SAE International, Warrendale, PA, USA.
Preliminary Invalidity Contentions of Defendant TomTom, Inc., Certificate of Service and Exhibit A filed May 16, 2011 in *Triangle Software, LLC.* V. *Garmin International, Inc. et al.*, Case No. 1:10-cv-1457-CMH-TCB in the United States District Court for the Eastern District of Virginia, Alexandria Division, 354 pages.
Raper, J.F., "Three-Dimensional GIS," in Geographical Information Systems: Principles and Applications, 1991, vol. 1, Chapter 20, 21 pages.
"Reference Manual for the Magellan RoadMate 500/700." 2003, 65 pages, Thales Navigation, Inc., San Dimas, CA, USA.
Riiett, L.R., "Simulating the TravTek Route Guidance Logic Using the Integration Traffic Model," Vehicle Navigation & Information System, P-253, Part 2, Oct. 1991, pp. 775-787, Soc. of Automotive Engineers, Inc., Warrendale, PA, USA.
Rillings, J.H., "Advanced Driver Information Systems," IEEE Transactions on Vehicular Technology, Feb. 1991, vol. 40, No. 1, pp. 31-40, IEEE, New York, NY, USA.
Rillings, J.H., "TravTek," Vehicle Navigation & Information System Conference Proceedings (VNIS'91), P-253, Part 2, Oct. 1991, pp. 729-737, Soc. Of Automotive Engineers, Inc., Warrendale, PA, USA.
Rockwell, Mark, "Telematics Speed Zone Ahead," Wireless Week, Jun. 15, 2004, Reed Business Information, http://www.wirelessweek.com.
Rupert, R.L., "The TravTek Traffic Management Center and Traffic Information Network," Vehicle Navigation & Information System Conference Proceedings (VNIS'91), P-253, Part 1, Oct. 1991, pp. 757-761, Soc. Of Automotive Engineers, Inc., Warrendale, PA, USA.
Schofer, J.L., "Behavioral Issues in the Design and Evaluation of Advanced Traveler Information Systems," Transportation Research Part C 1, 1993, pp. 107-117, Pergamon Press Ltd., Elsevier Science Ltd.
Schulz, W., "Traffic Management Improvement by Integrating Modem Communication Systems," IEEE Communications Magazine, Oct. 1996, pp. 56-60, New York, NY, USA.
Shepard, I.D.H., "Information Integration and GIS," in Geographical Information Systems: Principles and Applications, 1991, vol. 1, pp. Cover page, 337-360, end page.
Sirius Satellite Radio: Traffic Development Kit Start Up Guide, Sep. 27, 2005, Version 00.00.01, NY, New York, 14 pages.
Slothhower, D., "Sketches & Applications," SIGGRAPH 2001, pp. 138-144, Stanford University.
Sumner, R., "Data Fusion in Pathfinder and TravTek," Part 1, Vehicle Navigation & Information Systems Conference Proceedings (VNIS'91), Oct. 1991, Cover & Title page, pp. 71-75.
Supplemental Expert Report of William R. Michalson, Ph.D. Regarding Invalidity of the Patents-in-Suit dated Jul. 5, 2011 in *Triangle Software, LLC* v. *Garmin International Inc. et al.*, in the United States District Court for the Eastern District of Virginia, Alexandria Division, Case No. 1:10-cv-1457-CMH-TCB, 23 pages.
Tamuara et al., "Toward Realization of VICS—Vehicle Information and Communications System," IEEE-IEE Vehicle Navigation & Information Systems Conference (VNIS'93), 1993, pp. 72-77, held in Ottawa, Canada.
Taylor, K.B., "TravTek—Information and Services Center," Vehicle Navigation & Information System Conference Proceedings (VNIS'91), P-253, Part 2, Oct. 1991, pp. 763-774, Soc. Of Automotive Engineers, Inc., Warrendale, PA, USA.
Texas Transportation Institute, "2002 Urban Mobility Study: 220 Mobility Issues and Measures: The Effects of Incidents—Crashes and Vehicle Breakdowns" (2002).
"The Challenge of VICS: The Dialog Between the Car and Road has Begun," Oct. 1, 1996, pp. 19-63, The Road Traffic Information Communication System Centre (VICS Centre), Tokyo, Japan.
Thompson, S.M., "Exploiting Telecommunications to Delivery Real Time Transport Information," Road Transport Information and Control, Conf. Publication No. 454, Apr. 21-23, 1998, pp. 59-63, IEE, U.K.
Tonjes, R., "3D Reconstruction of Objects from Ariel Images Using a GIS," presented at ISPRS Workshops on "Theoretical and Practical Aspects of Surface Reconstructions and 3D Object Extraction" Sep. 9-11, 1997, 8 pages, held in Haifa, Israel.
"TRAVTEK Information and Services Center Policy/Procedures Manual," Feb. 1992, 133 pages, U.S. Department of Transportation, McLean, VA, USA.
Truett, R., "Car Navigation System May Live on After Test," The Orlando Sentinel, Feb. 17, 1993, p. 3 pages.
U.S. Dept. of Transportation, Closing the Data Gap: Guidelines for Quality Advanced Traveler Information System (ATIS) Data, Version 1.0, Sep. 2000, 41 pages.
User Guide of Tom Tom ONE; 2006.
Vollmer, R., "Navigation Systems—Intelligent Co-Drivers with Knowledge of Road and Tourist Information," Navigation and Intelligent Transportation Systems, Automotive Electronics Series, Society of Automotive Engineers, 1998, pp. Cover page, Table of Contents, pp. 9-17.
Volkswagen Group of America, Inc.'s Answer and Counterclaim, Feb. 24, 2011.
Watanabe, M. et al., "Development and Evaluation of a Car Navigation System Providing a Bird's-Eye View Map Display," Technical Paper No. 961007, Feb. 1, 1996, pp. 11-18, SAE International.
Wischhof, L. et al., "SOTIS—A Self-Organizing Traffic Information System," Proceedings of the 57th IEEE Vehicular Technology Conference (VTC—03), 2003, pp, 2442-2446, New York, NY, USA.
WSI, "TrueView Interactive Training Manual, Showfx Student Guide," Print Date: Sep. 2004, Document Version: 4.3x. Link: http://apollo.lsc.vsc.edu/intranet/WSI_Showfx/training/970-TVSK-SG-43.pdf.
XM Radio Introduces Satellite Update Service for Vehicle Navigation, Apr. 8, 2004, 2 pages.

(56) References Cited

OTHER PUBLICATIONS

Yim et al., TravInfo. Field Operational Test Evaluation "Evaluation of Travinfo Field Operation Test" Apr. 25, 2000.
Yim et al., "TravInfo Field Operational Test Evaluation: Information Service Providers Customer Survey", May 1, 2000.
Yokouchi, K., "Car-Navigation Systems," Mitsubishi Electr. Adv. Technical Reports, 2000, vol. 91, pp. 10-14, Japan.
You, J. et al., "Development and Evaluation of a Hybrid Travel Time Forecasting Model," Transportation Research Parc C 9, 2000, pp. 231-256, Pergamon Press Ltd., Elsevier Science Ltd., U.K.
Zhao, Y., "Vehicle Location and Navigation Systems," 1997, 370 pages, Arthech House, Inc., Norwood, MA, USA.
Zhu, C. et al. "3D Terrain Visualization for Web GIS," Center for Advance Media Technology, Nanyang Technological University, Singapore, 2003, 8 pages.
PCT Application No. PCT/US2004/23884, Search Report and Written Opinion dated Jun. 17, 2005.
PCT Application No. PCT/US2011/48680, Search Report and Written Opinion dated Feb. 7, 2012.
PCT Application No. PCT/US2011/51647, Search Report and Written Opinion dated Feb. 2, 2012.
PCT Application No. PCT/US2011/60663, Search Report and Written Opinion dated May 31, 2012.
PCT Application No. PCT/US2012/38702, Search Report and Written Opinion dated Aug. 24, 2012.
PCT Application No. PCT/US2013/23505, Search Report and Written Opinion dated May 10, 2013.
U.S. Appl. No. 10/379,967, Final Office Action dated May 11, 2005.
U.S. Appl. No. 10/379,967, Office Action dated Sep. 20, 2004.
U.S. Appl. No. 10/897,550, Office Action dated Jun. 12, 2009.
U.S. Appl. No. 10/897,550, Office Action dated Jan. 21, 2009.
U.S. Appl. No. 10/897,550, Office Action dated Aug. 1, 2008.
U.S. Appl. No. 10/897,550, Office Action dated Oct. 3, 2007.
U.S. Appl. No. 11/509,954, Office Action dated Nov. 23, 2007.
U.S. Appl. No. 11/751,628, Office Action dated Jan. 29, 2009.
U.S. Appl. No. 12/283,748, Office Action dated Aug. 20, 2009.
U.S. Appl. No. 12/283,748, Office Action dated Mar. 11, 2009.
U.S. Appl. No. 12/398,120, Final Office Action dated Mar. 26, 2013.
U.S. Appl. No. 12/398,120, Office Action dated Nov. 14, 2012.
U.S. Appl. No. 12/398,120, Final Office Action dated Apr. 12, 2012.
U.S. Appl. No. 12/398,120, Office Action dated Nov. 15, 2011.
U.S. Appl. No. 12/763,199, Final Office Action dated Nov. 1, 2010.
U.S. Appl. No. 12/763,199, Office Action dated Aug. 5, 2010.
U.S. Appl. No. 12/860,700, Final Office Action dated Jun. 26, 2013.
U.S. Appl. No. 12/860,700, Office Action dated Feb. 26, 2013.
U.S. Appl. No. 12/881,690, Office Action dated Jan. 9, 2014.
U.S. Appl. No. 12/881,690, Final Office Action dated Aug. 9, 2013.
U.S. Appl. No. 12/881,690, Office Action dated Apr. 22, 2013.
U.S. Appl. No. 12/967,045, Final Office Action dated Jun. 27, 2012.
U.S. Appl. No. 12/967,045, Office Action dated Jul. 18, 2011.
U.S. Appl. No. 13/296,108, Final Office Action dated Oct. 25, 2013.
U.S. Appl. No. 13/296,108, Office Action dated May 9, 2013.
U.S. Appl. No. 13/316,250, Final Office Action dated Jun. 24, 2013.
U.S. Appl. No. 13/316,250, Office Action dated Jan. 18, 2013.
U.S. Appl. No. 13/475,502, Final Office Action dated Sep. 10, 2013.
U.S. Appl. No. 13/475,502, Office Action dated Apr. 22, 2013.
U.S. Appl. No. 13/561,269, Office Action dated Dec. 13, 2012.
U.S. Appl. No. 13/561,327, Office Action dated Oct. 26, 2012.
U.S. Appl. No. 13/747,454, Office Action dated Jun. 17, 2013.
U.S. Appl. No. 13/752,351, Office Action dated Jul. 22, 2013.
U.S. Appl. No. 12/881,690, Final Office Action dated May 21, 2014.
U.S. Appl. No. 14/327,468, Andre Gueziec, GPS Generated Traffic Information, filed Jul. 9, 2014.
U.S. Appl. No. 14/323,352 , J.D. Margulici, Estimating Time Travel Distributions on Signalized Arterials, filed Jul. 3, 2014.
U.S. Appl. No. 14/846,576, Christopher Kantarjiev, System and Method for Delivering Departure Notifications, filed Sep. 4, 2015.
U.S. Appl. No. 14/793,879, Andre Gueziec, Generating Visual Information Associated With Traffic, filed Jul. 8, 2015.
U.S. Appl. No. 14/726,858, Andre Gueziec, Gesture Based Interaction With Traffic Data, filed Jun. 1, 2015.
"U.S. Appl. No. 16/195,439, Preliminary Amendment filed Nov. 27, 2018", 8 pgs.
"European Application Serial No. 18191898.8, Extended European Search Report dated Dec. 3, 2018", 8 pgs.

* cited by examiner

Time-of-day distributions of the pace in 15-min period over 30 days

Time-of-day distributions of the pace in 15-min period over 30 days

Time-of-day distributions of the pace in 15-min period over 30 days

Seg. length: 1.388 km Med. samp. size: 66 # samples: 21

ESTIMATING TIME TRAVEL DISTRIBUTIONS ON SIGNALIZED ARTERIALS

CROSS-REFERENCE TO RELATED APPLICATION

This application is a continuation-in-part of U.S. application Ser. No. 13/752,351, filed on Jan. 28, 2013 and title "Estimating Time Travel Distributions on Signalized Arterials," the disclosure of which is incorporated herein by reference. This application also claims the priority benefit of U.S. provisional application No. 61/715,713, filed on Oct. 18, 2012 and titled "Estimation of Time Travel Distributions on Signalized Arterials," the disclosure of which is incorporated herein by reference.

BACKGROUND

Field of Invention

The present disclosure generally concerns traffic management. More specifically, the present disclosure concerns estimating time travel distributions on signalized arterials and thoroughfares.

Description of Related Art

Systems for estimating traffic conditions have historically focused on highways. Highways carry a majority of all vehicle-miles traveled on roads and are instrumented with traffic detectors. Notably, highways lack traffic signals (i.e., they are not "signalized"). Estimating traffic conditions on signalized streets represents a far greater challenge for two main reasons. First, traffic flows are interrupted because vehicles must stop at signalized intersections. These interruptions generate complex traffic patterns. Second, instrumentation amongst signalized arterials is sparse because the low traffic volumes make such instrumentation difficult to justify economically.

In recent years, however, global positioning system (GPS) connected devices have become a viable alternative to traditional traffic detectors for collecting data. As a result of the permeation of GPS connected devices, travel information services now commonly offer information related to arterial conditions. For example, travel information services provided by Google Inc. of Mountain View, Calif. and Inrix, Inc. of Kirkland, Wash., are known at this time. Although such information is frequently available, the actual quality of the traffic estimations provided remains dubious.

Even the most cursory of comparisons between information from multiple service providers reveals glaring differences in approximated signalized arterial traffic conditions. The low quality of such estimations is usually a result of having been produced from a limited set of observations. Recent efforts, however, have sought to increase data collection by using re-identification technologies.

Such techniques have been based on be based on magnetic signatures, toll tags, license plates, or embedded devices. The sampling sizes obtained from such technologies are orders of magnitude greater than those obtained from mobile GPS units. Sensys Networks, Inc. of Berkeley, Calif., for example, collects arterial travel time data using magnetic re-identification and yields sampling rates of up to 50%. Notwithstanding these recently improved observation techniques, there remains a need to provide more accurate estimates of traffic conditions on signalized arterials.

SUMMARY

A system for estimating time travel distributions on signalized arterials may include a processor, memory, and an application stored in memory. The application may be executable by the processor to receive data regarding travel times on a signalized arterial, estimate a present distribution of the travel times, estimate a prior distribution based on one or more travel time observations, and calibrate the present distribution based on the prior distribution. In some embodiments, the system may further include estimating traffic conditions for a particular signalized arterial segment and displaying the estimates to a user through a graphical interface of a mobile device.

A method for estimating time travel distributions on signalized arterials may include receiving travel data and executing instructions stored in memory. Execution of the instructions by a computer processor may estimate a distribution based on the travel data and calibrate the distribution. In some embodiments, the method may further include estimating traffic conditions for a particular signalized arterial segment and displaying the estimates to a user through a graphical interface of a mobile device.

DETAILED DESCRIPTION

Figure 1:
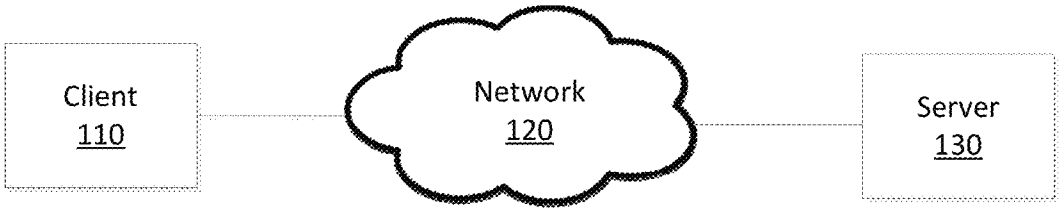
FIG. 1 is a block diagram of a system for estimating time travel distributions on signalized arterials.

FIG. 1 is a block diagram of a system for estimating time travel distributions on signalized arterials. The system of FIG. 1 includes a client computer 110, network 120, and a server 130. Client computer 110 and server 130 may communicate with one another over network 120. Client computer 110 may be implemented as a desktop, laptop, work station, notebook, tablet computer, smart phones, mobile device or other computing device. Network 120 may be implemented as one or more of a private network, public network, WAN, LAN, an intranet, the Internet, a cellular network or a combination of these networks.

Client computer 110 may implement all or a portion of the functionality described herein, including receive traffic data and other data or and information from devices using re-identification technologies. Such technologies may be based on magnetic signatures, toll tags, license plates, or embedded devices, such as Bluetooth receivers. Notably, sampling sizes obtained from such technologies can be orders of magnitude greater than those obtained from mobile GPS units. Notwithstanding that fact, server 130 may also receive probe data from GPS-connected mobile devices. Server 130 may communicate data directly with such data collection devices. Server 130 may also communicate, such as by sending and receiving data, with a third-party server, such as the one maintained by Sensys Networks, Inc. of Berkeley, Calif. and accessible through the Internet at www.sensysresearch.com.

Server computer 130 may communicate with client computer 110 over network 120. Server computer may perform all or a portion of the functionality discussed herein, which may alternatively be distributed between client computer 110 and server 130, or may be provided by server 130 as a network service for client 110. Each of client 110 and server computer 130 are listed as a single block, but it is envisioned that either be implemented using one or more actual or logical machines.

In one embodiment, the system may utilize Bayesian Inference principles to update a prior belief based on new data. In such an embodiment, the system may determine the distribution of travel times y on a given signalized arterial at the present time T. The prior beliefs may include the shape of the travel time distribution and the range of its possible parameters $\theta_T$ (e.g., mean and standard deviation) that are typical of a given time of day, such that y follows a probability function $p(y|\theta_T)$. These parameters themselves may follow a probability distribution $p(\theta_T|\alpha_T)$ called the prior distribution. The prior distribution may comprise its own set of parameters $\alpha_T$, which are referred to as hyper-parameters.

The system may estimate the current parameters using a recent (e.g., 20 minutes ago or less in some embodiments) travel time observation of the arterial of interest. The system may also account for observations on neighboring streets. In still further embodiments, the system may consider contextual evidence such as local weather, incidents, and special events such as sporting events, one off road closures, or other intermittent traffic diversions. In one embodiment, $y_i^*$ may designate the current travel time observations. The system may determine the likeliest $\theta_T$ using a known $y_i^*$ and $\alpha_T$.

The system 100 may account for one or more travel time variability components. First, there may be individual variations between vehicles traveling at the same time of day. These variations stem from diverse driving profiles among drivers and their varying luck with traffic signals. Second, there may be recurring time-of-day variations that stem from fluctuating traffic demand patterns and signal timing. Third, there may be daily variations in the distributions of travel times over a given time slot. System 100 may account for other time travel variability components.

In one exemplary embodiment, the system 100 may employ standard Traffic Message Channel (TMC) location codes as base units of space, and fifteen-minute periods as base units of time. In such an embodiment, the system 100 approximates that traffic conditions remain homogeneous across a given TMC location code over each fifteen-minute period. The system 100 may also use other spatial or temporal time units depending on the degree of precision desired. For example, the system 100 may use a slightly coarser scale for the base units of space (e.g., segments a few miles or kilometers long) to mitigate noise in the travel time data. Alternatively, the system 100 may use reidentification segments as the base units in the space domain. In such embodiments, the system 100 approximates that traffic conditions remain homogenous across a given reidentification segment over each fifteen-minute period. System 100 may also normalize travel time data into a unit of pace that is expressed in seconds per mile or seconds per kilometer. The system 100 may also calculate the average pace as a linear combination of individual paces weighted by distance traveled. Such calculations may be more convenient than using speed values.

System 100 may generate thousands of data plots of various types. For example, system 100 may generate boxed plots that represent the dispersion of travel times along a segment at various times of day. Those plots can be built either for a single day or by aggregating multiple days. System 100 may also generate travel time histograms that represent the distribution of travel times for a given slice of the data—typically a particular segment and time slot, either for a single day or multiple days taken in aggregate. The travel time histograms may be produced in at least series of three types: time-of-day singles, which show a single day's sequence in fifteen minute increments; time-of-day aggregates, which show time-of-day variations using an aggregate of multiple days; and daily time slot plots, which show the same time slot over multiple days. In various embodiments, other series types may likewise be generated and analyzed in accordance with the system and methods disclosed herein.

System 100 may also generate parameter plots, which represent the variations of key distribution parameters such as the min, max, $25^{th}$ $50^{th}$, or $75^{th}$ percentile or given interpercentiles as histograms. Parameter plots may be generated in at least three different ways: time-of-day parameter plots, which represent percentile variations during the day for each individual date; daily time slot parameter plots, which represent percentile variations across different days for every time slot; and density maps, which are two-dimensional plots of one percentile versus another for a given set of time slots and dates.

Figure 2:
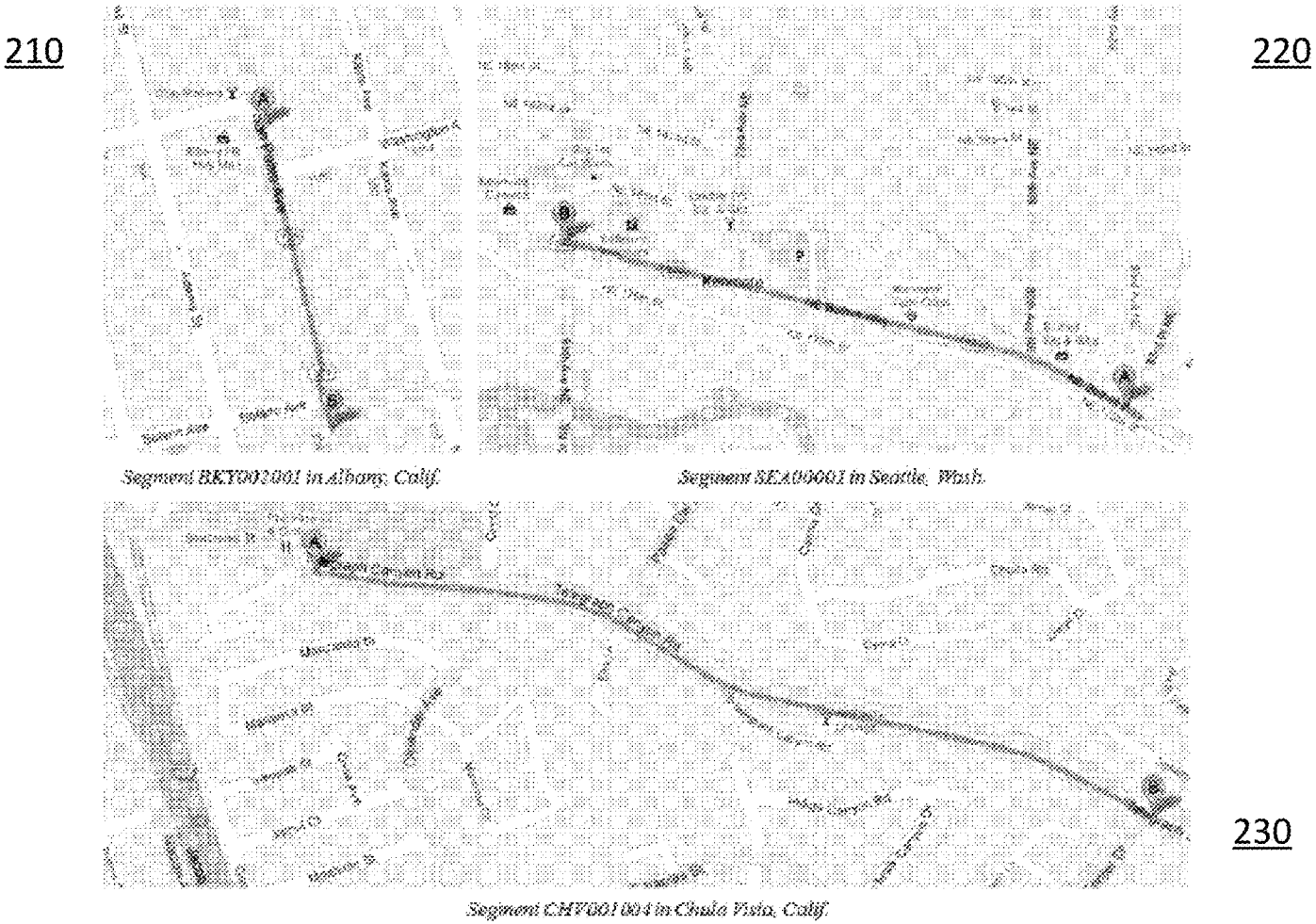
FIG. 2 is a series of maps 200 highlighting exemplary signalized arterial segments that may be analyzed using the technology disclosed herein.

FIG. 2 is a series of maps 200 highlighting exemplary signalized arterial segments that may be analyzed using the technology disclosed herein. Map 210 shows exemplary signalized arterial segment "BKY002001" located in Albany, Calif. Map 220 shows exemplary signalized arterial segment "SEA000001" located in Seattle, Wash. Map 230 shows exemplary signalized arterial segment "CHV001004" located in Chula Vista, Calif.

Figure 3:
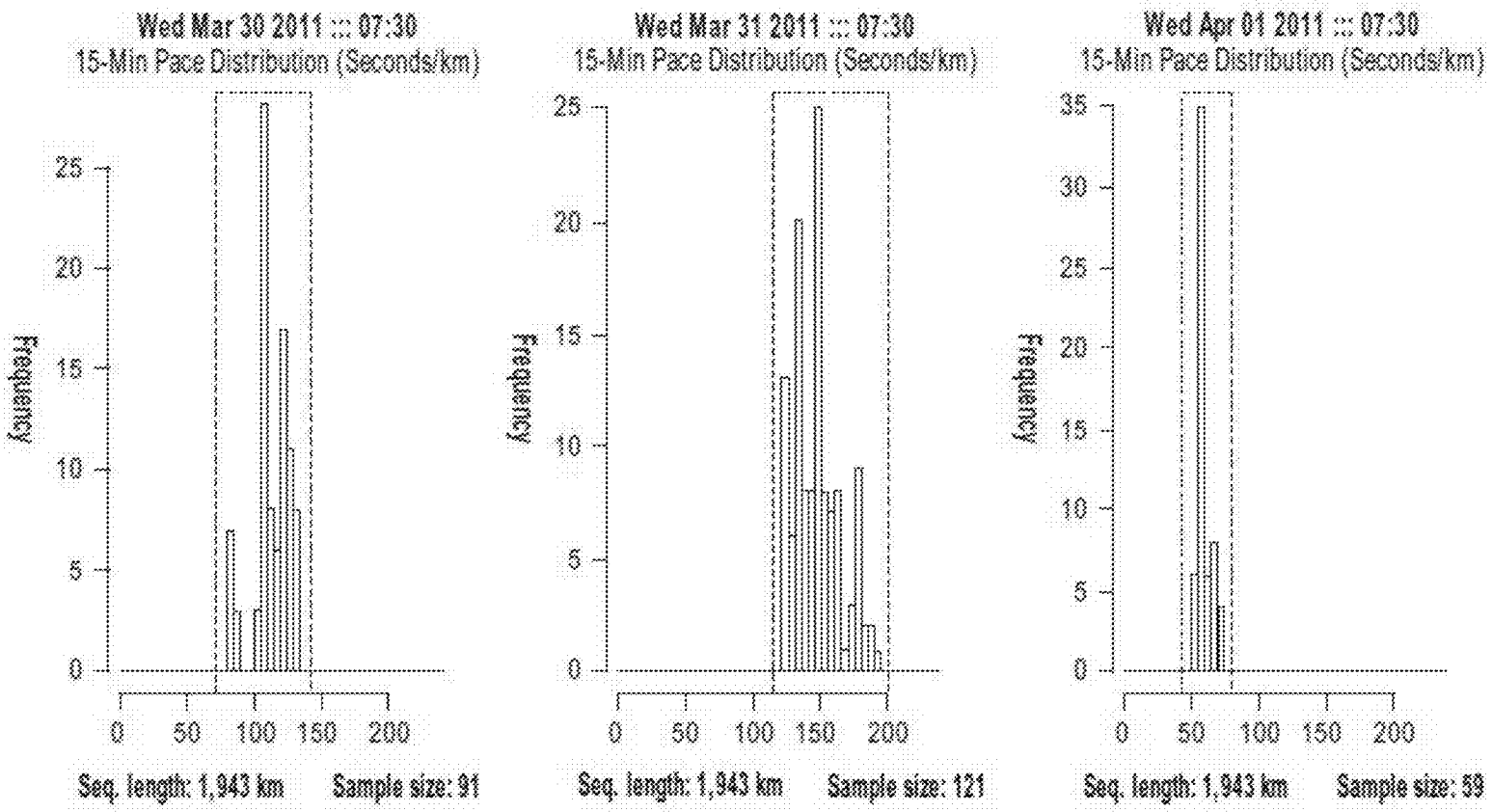
FIG. 3 is a series of graphs showing distributions of pace on a signalized arterial segment at the same time on over three consecutive days.

FIG. 3 is a series of graphs showing distributions of pace on a signalized arterial segment at the same time on over three consecutive days. More specifically, FIG. 3 shows an exemplary distribution of pace on a 2-km arterial segment in Seattle, Wash. for the same fifteen-minute time period on three consecutive days. As suggested in FIG. 3, determining an exact distribution shape for a given fifteen minute period on any given day may pose a difficult objective. The presently described system can, however, directly observe three different states of an arterial segment and then calibrate the prior probabilities of being in either state from archived data. The system may also use real-time data to help refine a given belief regarding which of the multiple states applies to the real-time prediction.

Figure 4:
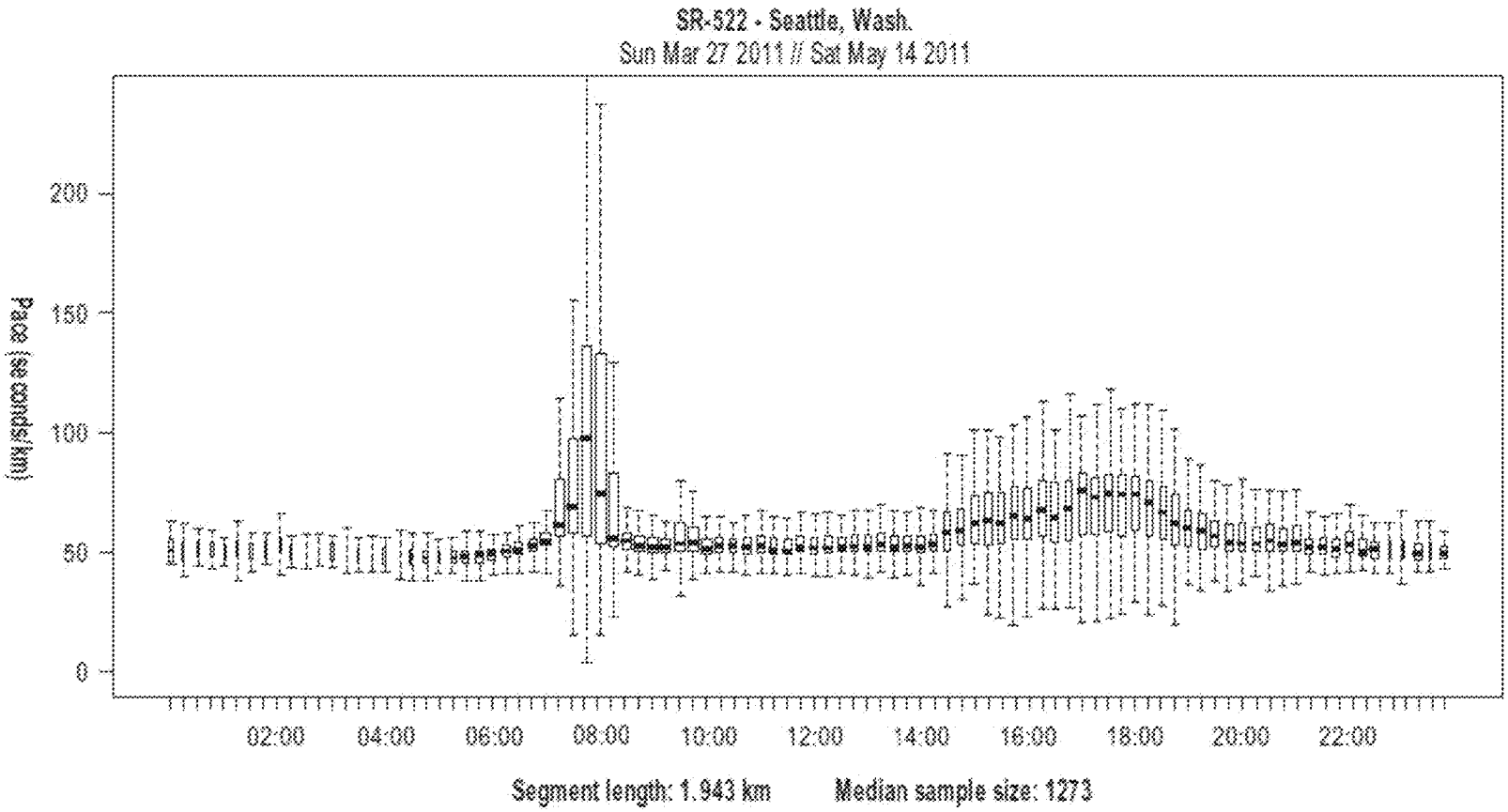
FIG. 4 is a graph showing variations in pace throughout different times periods time periods in a day.

FIG. 4 is a graph showing variations in pace throughout different times periods in a day. As shown in FIG. 4, the presently disclosed system may account for time-of-day variations. Notably, the box indicates the $25^{th}$, $50^{th}$, and $75^{th}$ percentile value while the dotted lines extend to extreme values. In such embodiments, the system may use data regarding regular patterns of increase and decrease in travel times to calibrate prior distributions by time of day.

Figure 5:
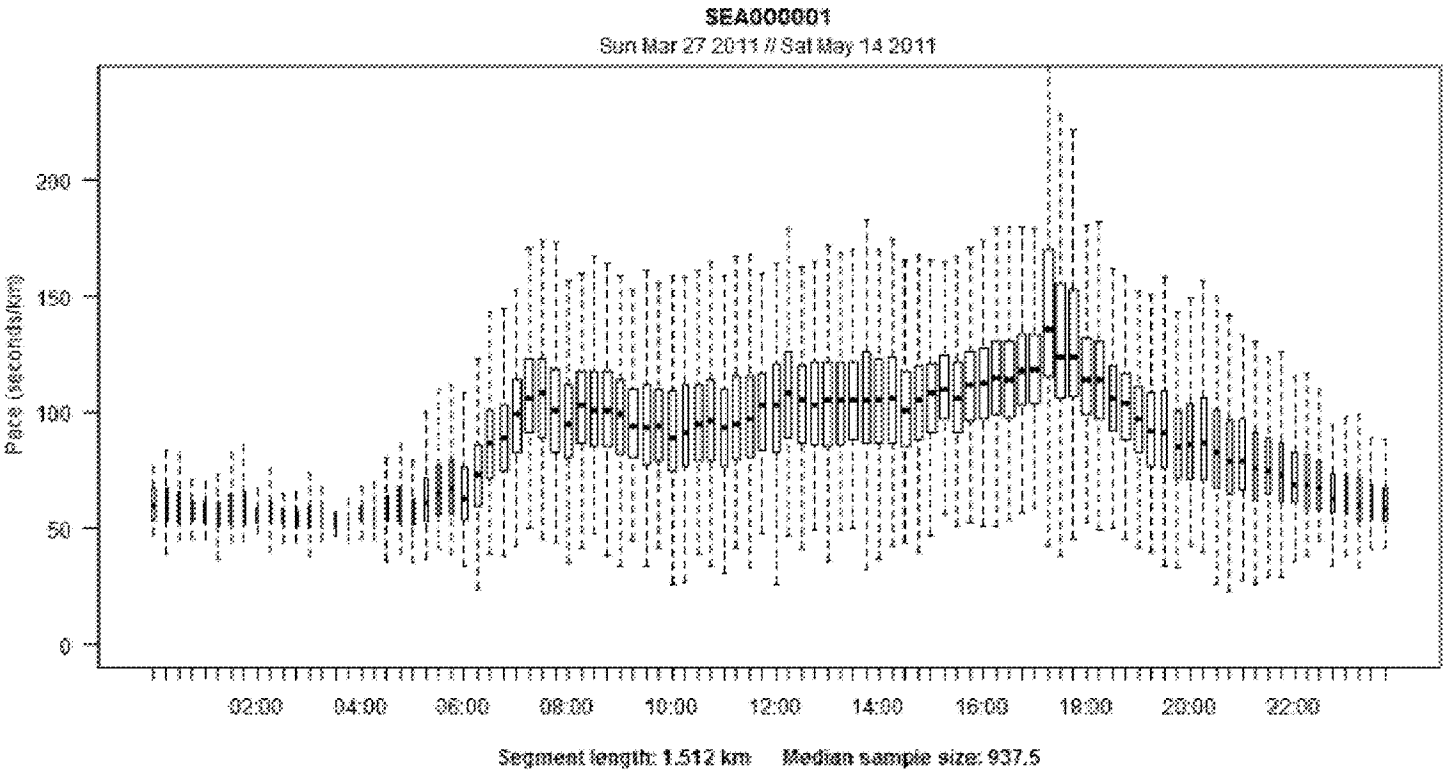
FIG. 5 is another graph showing variations in pace throughout different time periods in a day.

FIG. 5 is another time-of-day distribution graph showing variations in pace throughout different time periods in a day. More specifically, FIG. 5 shows a boxed plot of travel time dispersion by time of day across approximately 30 days in fifteen minute intervals. As in FIG. 4, the boxes indicate the $25^{th}$, $50^{th}$ (black dot), and $75^{th}$ percentiles, while the dotted lines or "whiskers" extend to the minimum and maximum.

Figure 6:
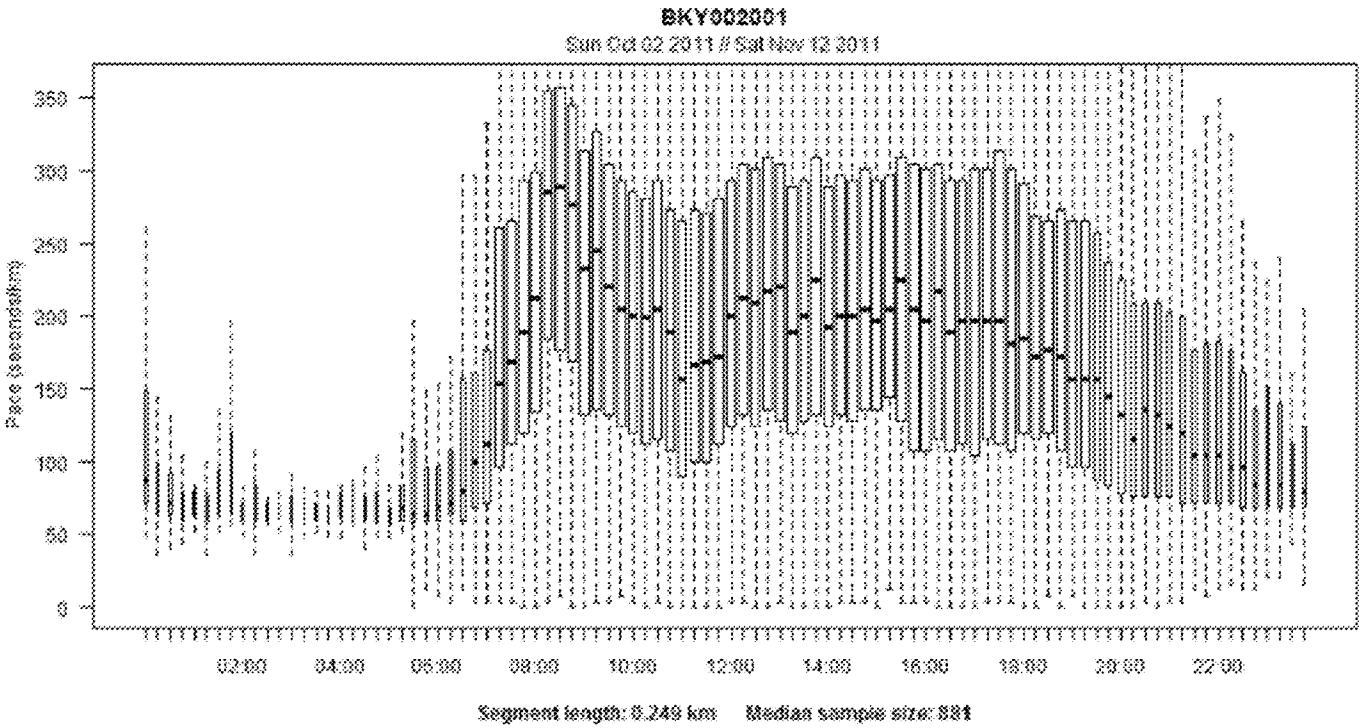
FIG. 6 is another graph showing variations in pace throughout different time periods in a day.

FIG. 6 is yet another graph showing variations in pace throughout different time periods in a day. FIG. 6 represents an exemplary data set from a different arterial segment than that illustrated in FIGS. 4 and 5. Namely, FIGS. 4 and 5 illustrate an exemplary data set from segment SEA000001 in Seattle, Wash., while FIG. 6 illustrates an exemplary data set from segment BKY002001 in Albany, Calif. As in FIGS. 4 and 5, the boxes indicate the $25^{th}$, $50^{th}$ (black dot), and $75^{th}$ percentiles, while the dotted lines or "whiskers" extend to the minimum and maximum.

Figure 7:
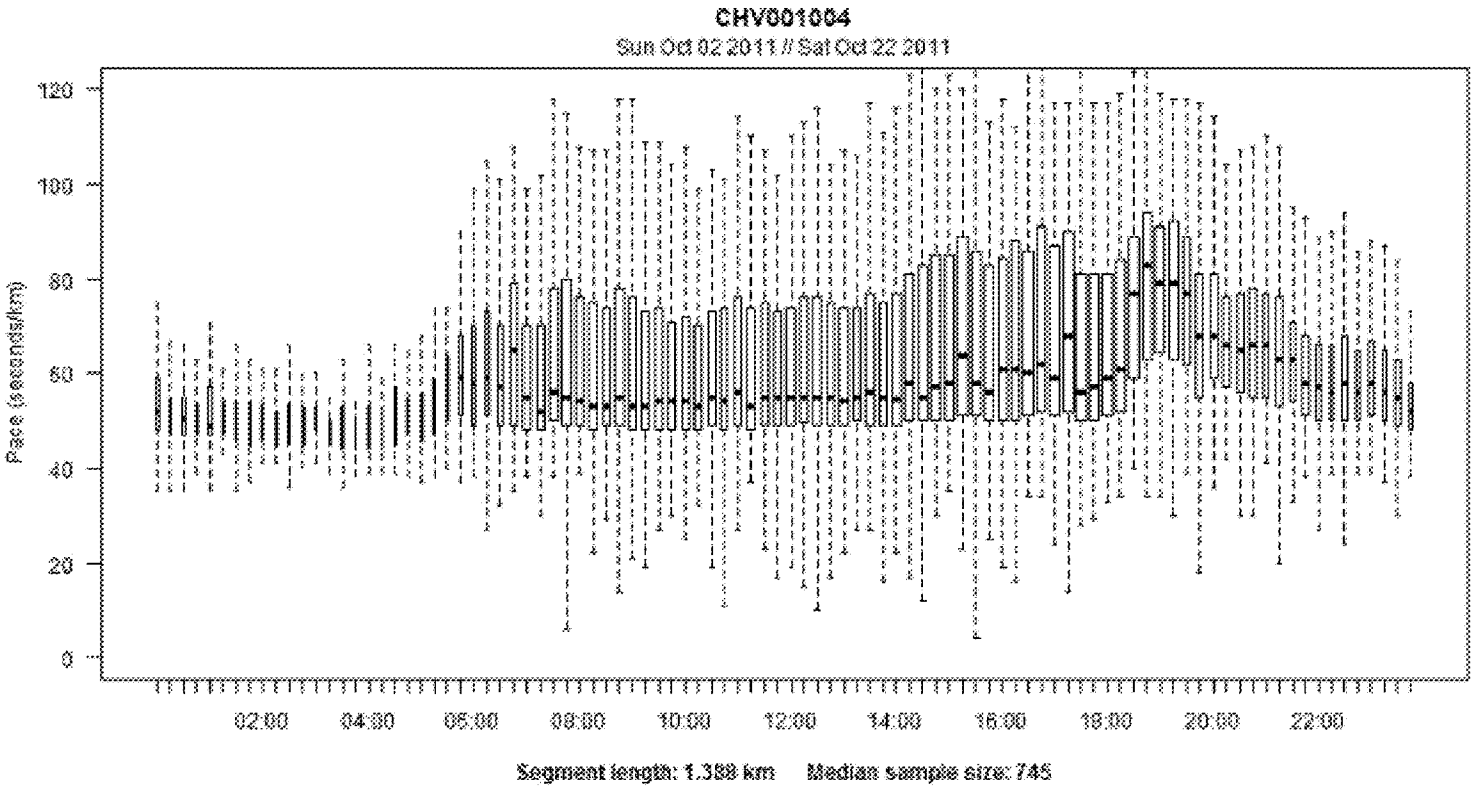
FIG. 7 is another graph showing variations in pace throughout different time periods in a day.

FIG. 7 is another graph showing variations in pace throughout different time periods in a day. FIG. 7 represents an exemplary data set from a different arterial segment than those illustrated in FIGS. 4, 5, and 6. Namely, FIG. 7 illustrates an exemplary data set from segment CHV001004 in Chula Vista, Calif. As in FIGS. 4-6, the boxes indicate the $25^{th}$, $50^{th}$ (black dot), and $75^{th}$ percentiles, while the dotted lines or "whiskers" extend to the minimum and maximum.

Figure 8A:
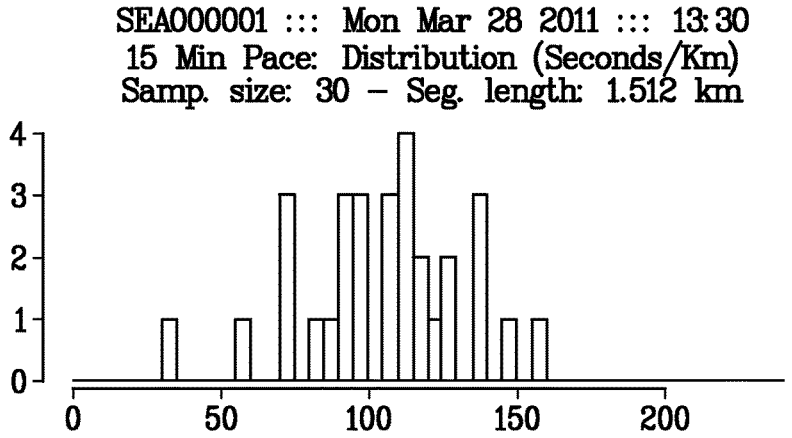
FIGS. 8A-X are a series of histograms showing the diversity of possible distribution shapes generated by the system and methods disclosed herein.
Figure 8B:
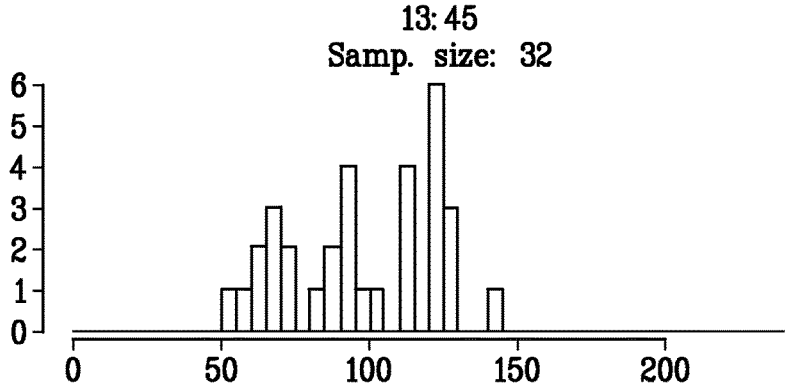
Figure 8C:
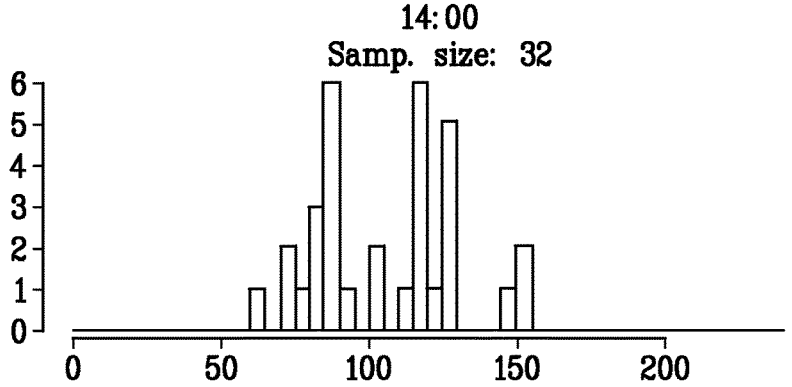
Figure 8D:
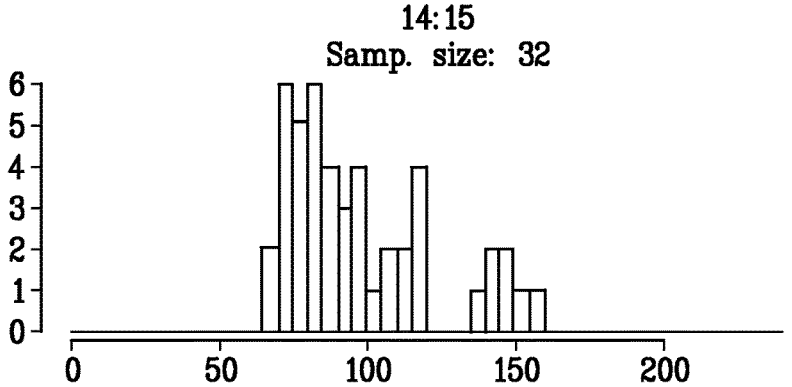
Figure 8E:
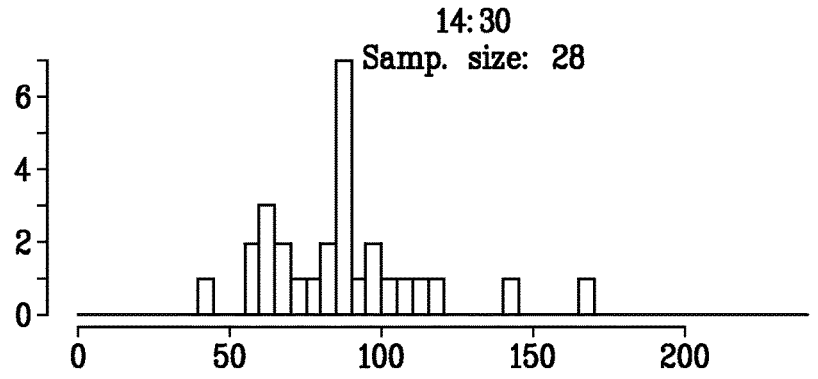
Figure 8F:
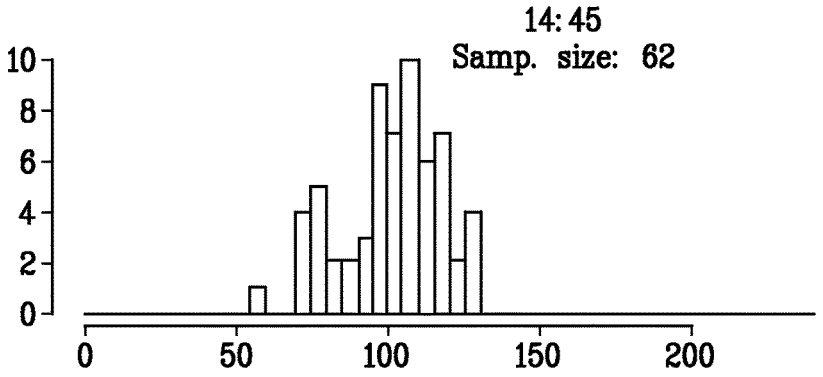
Figure 8G:
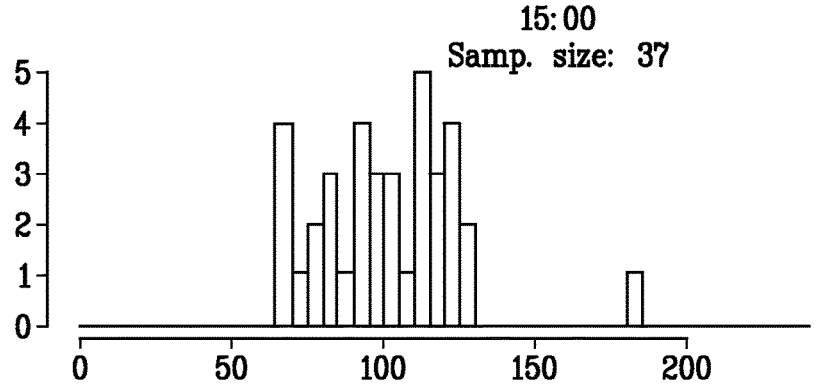
Figure 8H:
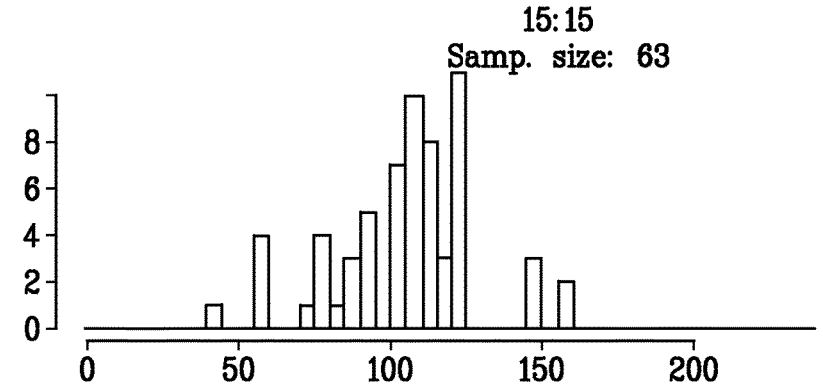
Figure 8I:
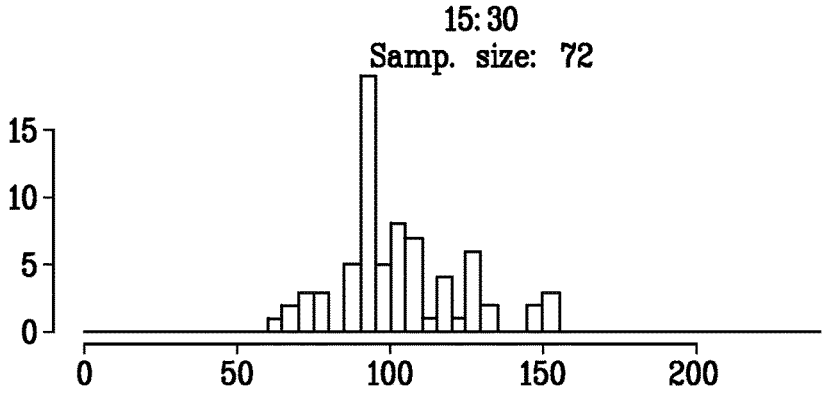
Figure 8J:
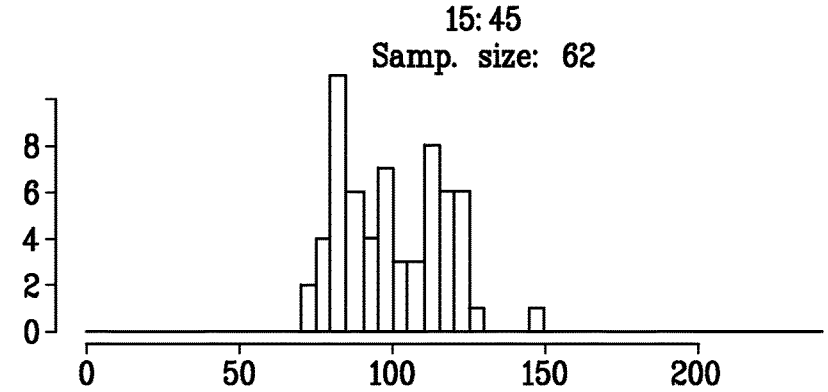
Figure 8K:
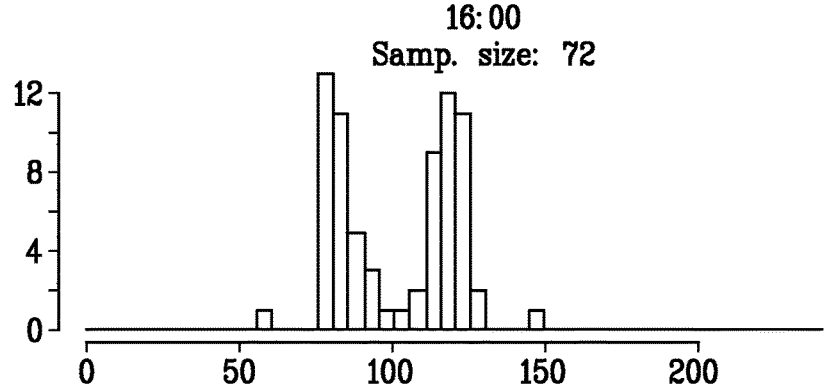
Figure 8L:
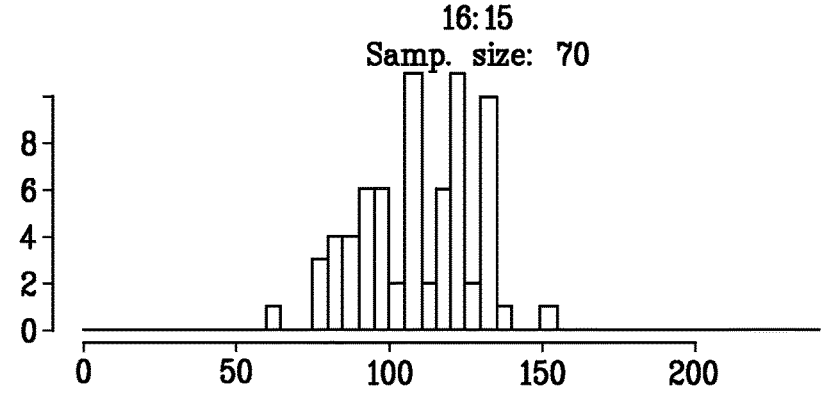
Figure 8M:
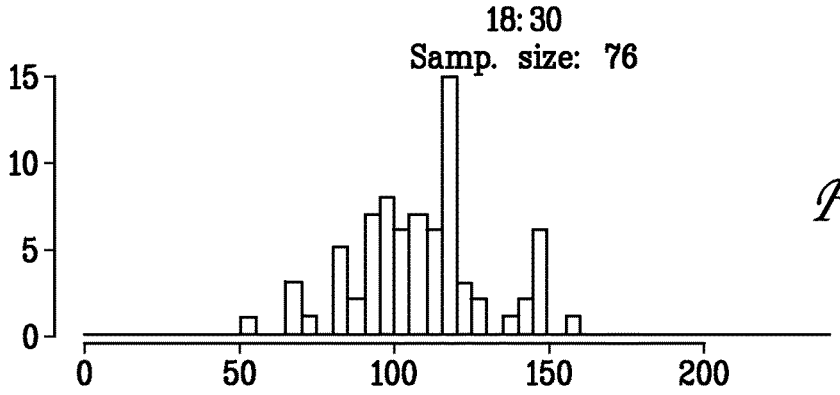
Figure 8N:
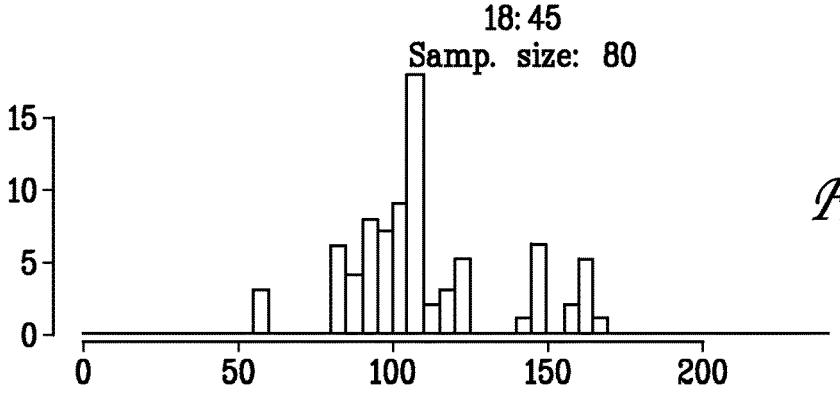
Figure 8O:
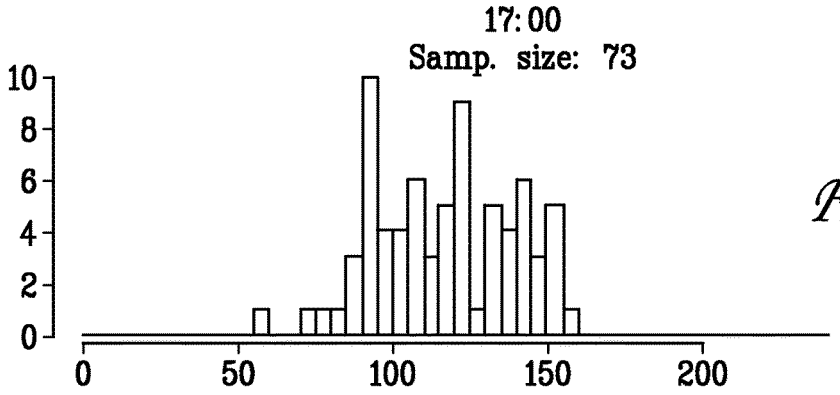
Figure 8P:
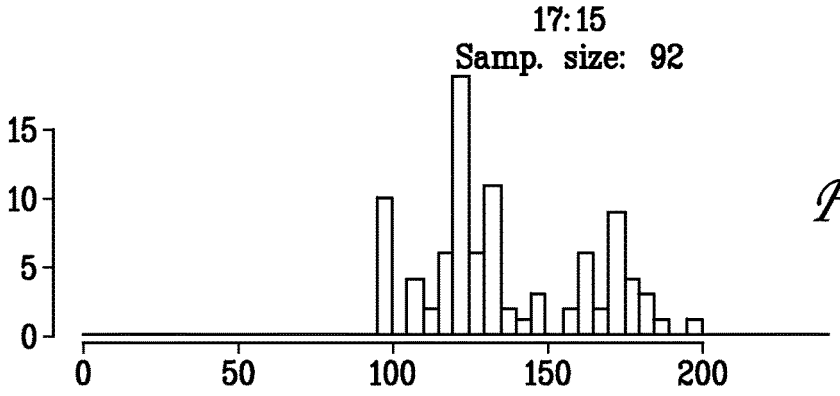
Figure 8Q:
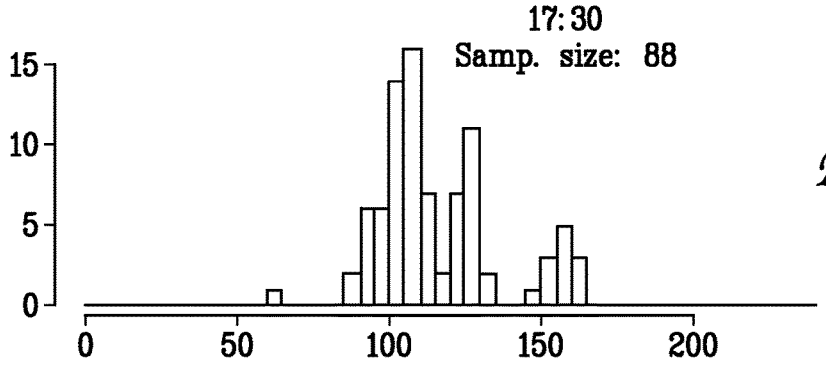
Figure 8R:
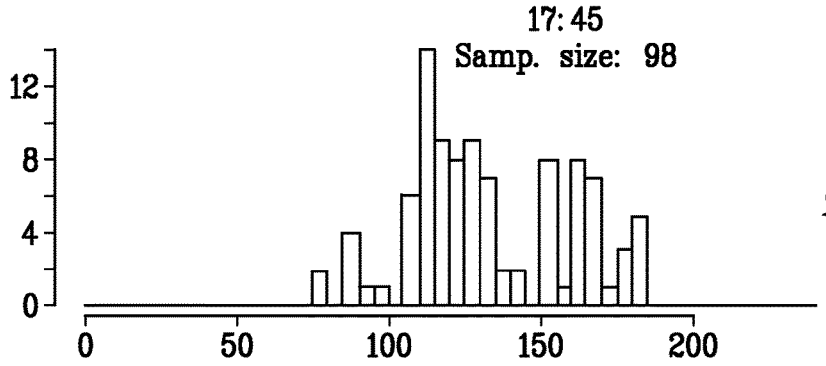
Figure 8S:
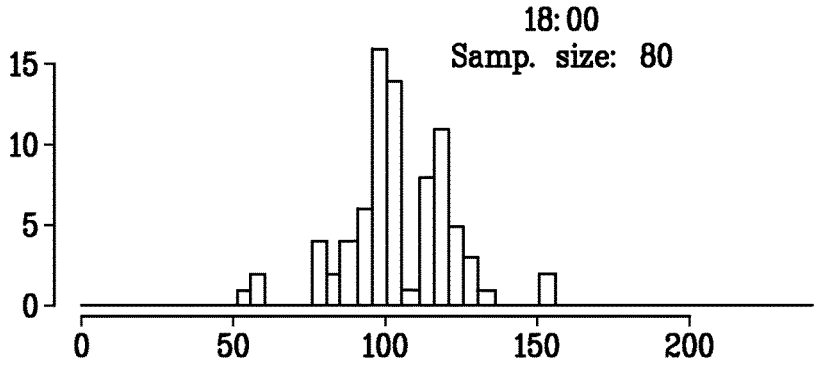
Figure 8T:
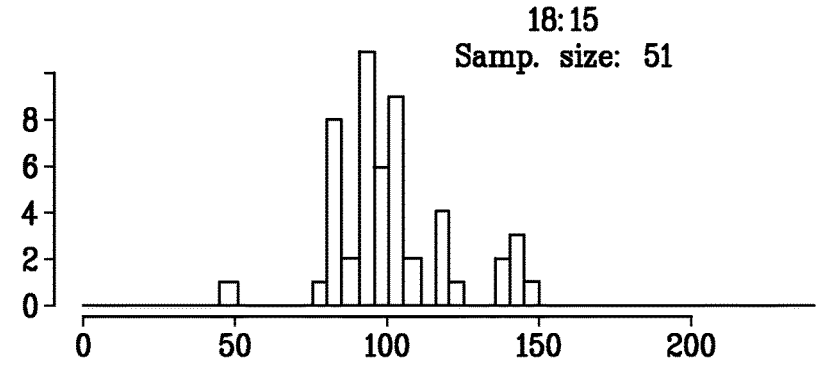
Figure 8U:
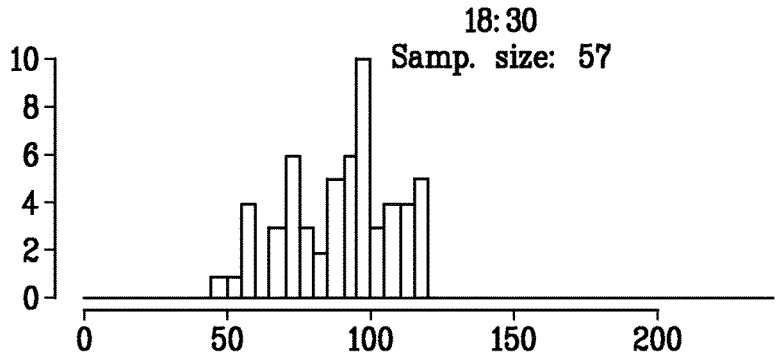
Figure 8V:
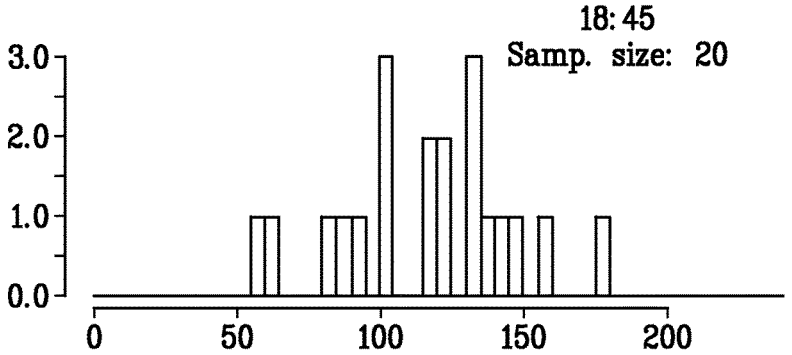
Figure 8W:
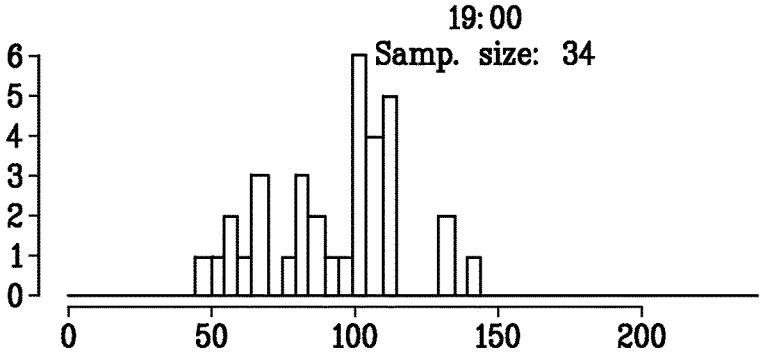
Figure 8X:
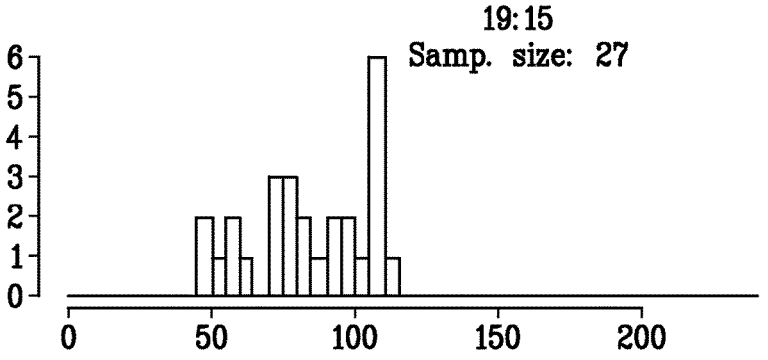

FIGS. 8A-X are a series of histograms showing the diversity of possible distribution shapes generated by the system and methods disclosed herein. Specifically, FIGS. 8A-X display histograms for sequential fifteen-minute periods on a particular day between 1:30 PM and 4:30 PM, where the time periods are shown in 24-hour notation in FIGS. 8A-X. The histograms shown in FIGS. 8A-X reveal a variety of distribution forms. System 100 may generate one or more of those forms depending on the system configuration and the data collection goal. Those forms may include relatively uniform distribution forms, forms featuring a sharp peak, or forms clearly exhibiting multiple modes.

Figure 9A:
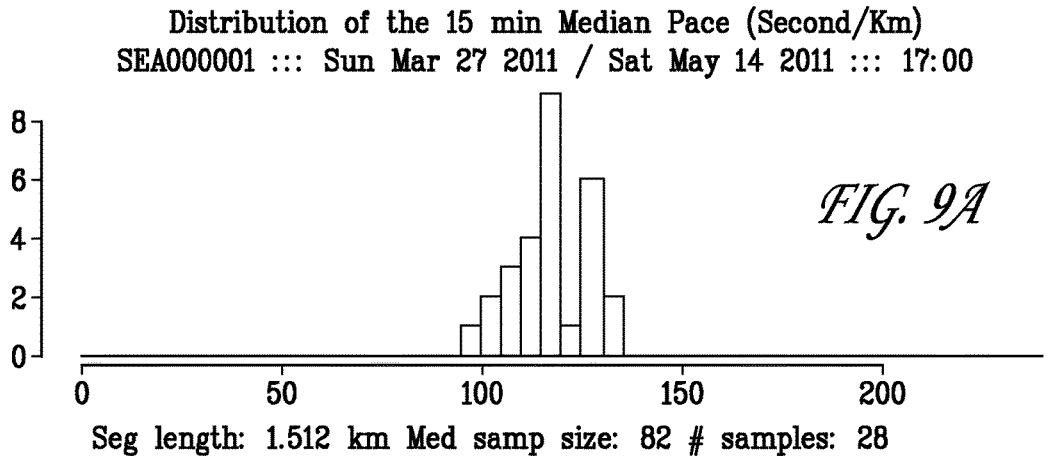
FIGS. 9A-F are another series of graphs showing the distribution of certain parameters for two consecutive time slots from approximately 30 days of data.
Figure 9B:
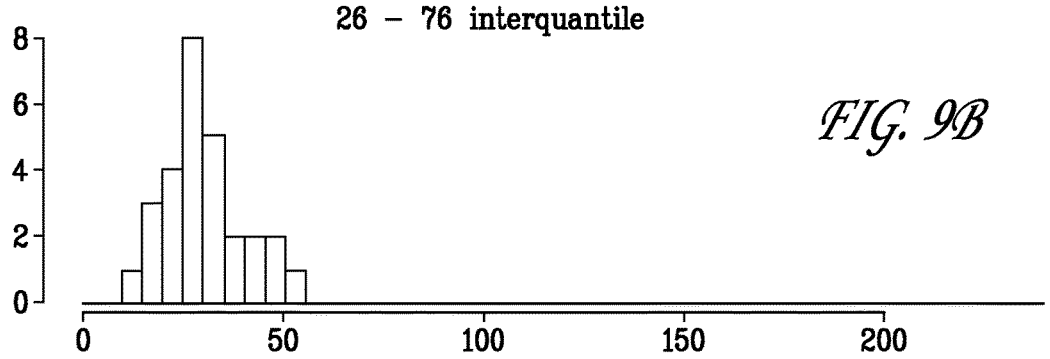
Figure 9C:
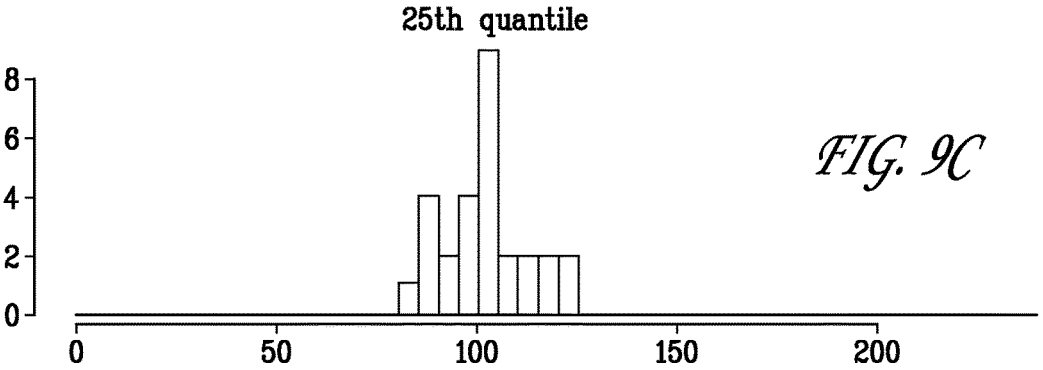
Figure 9D:
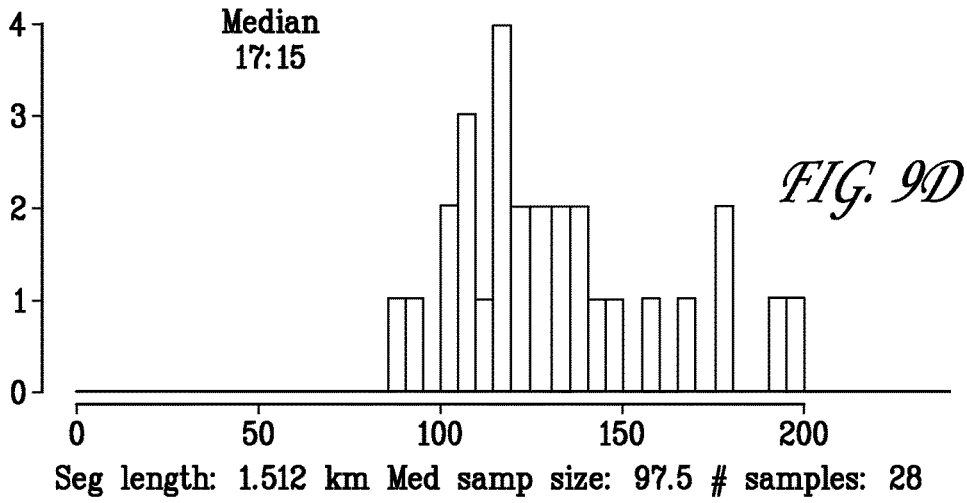
Figure 9E:
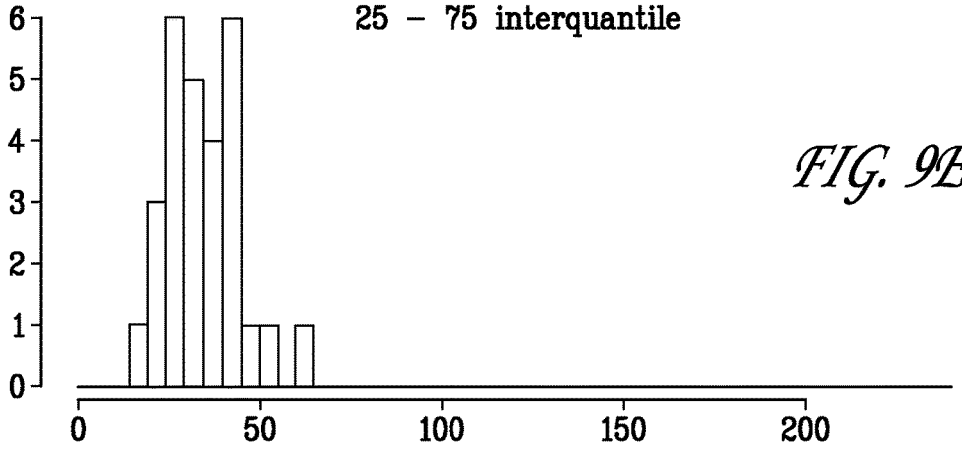
Figure 9F:
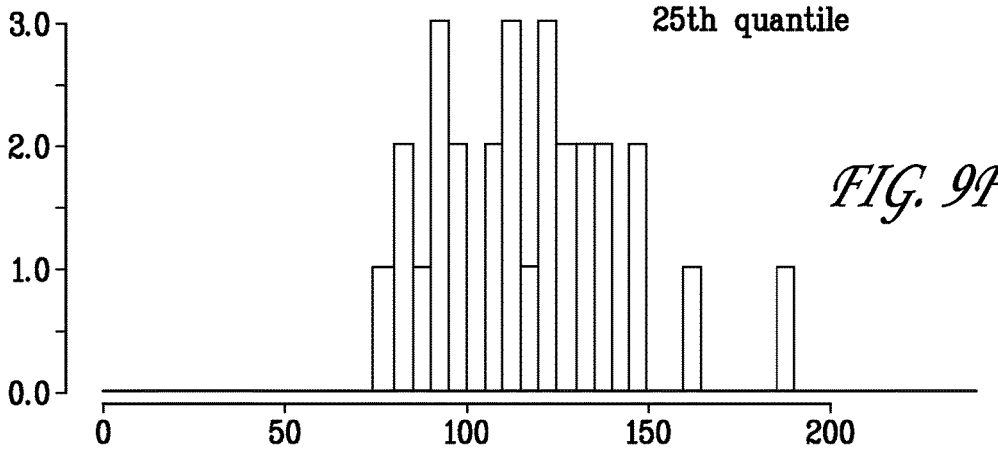
Figures 10A, 10B, 10C, 10D:
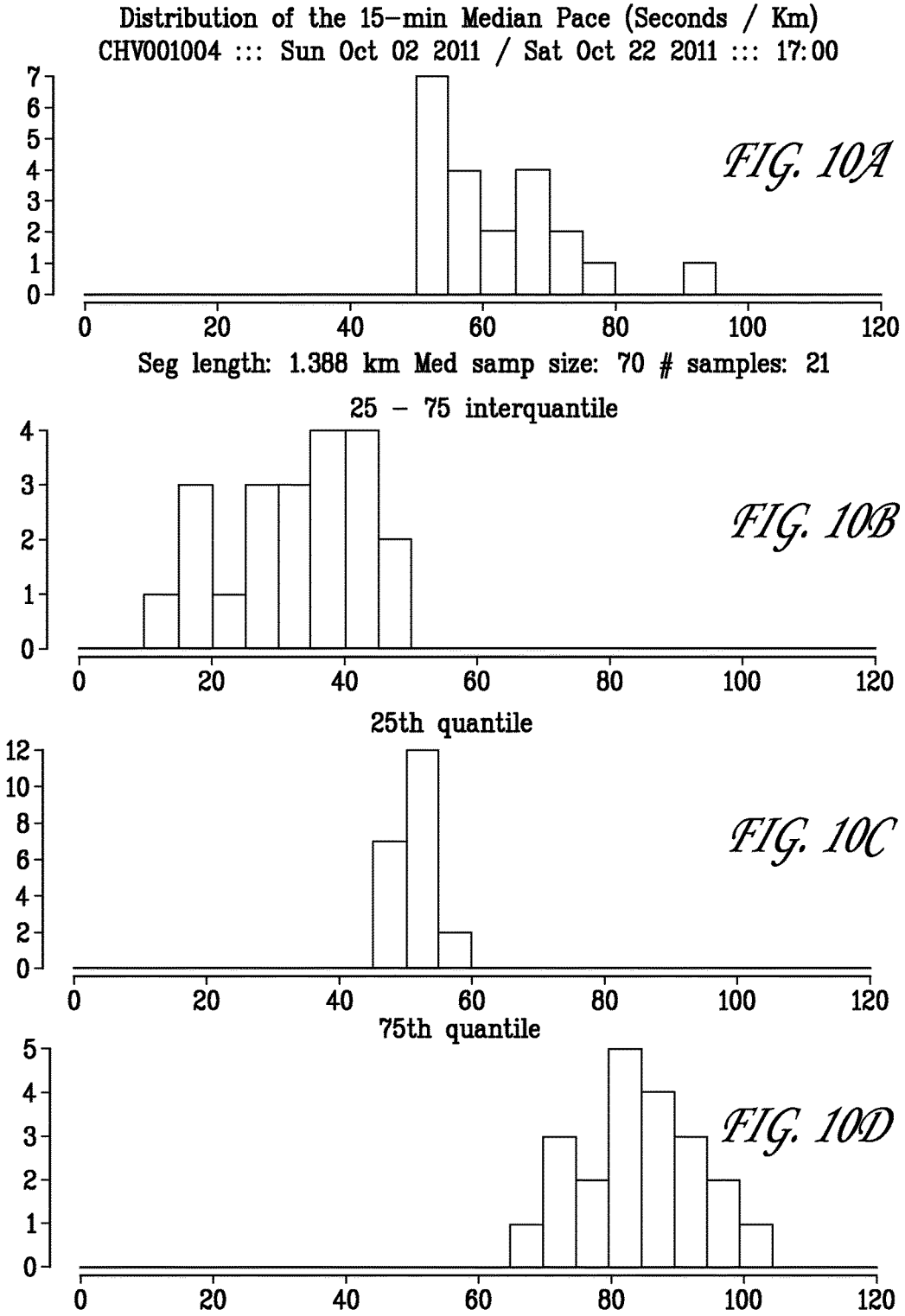
FIGS. 10A-P are a series of graphs showing an exemplary quantile distribution.
Figure 10E:
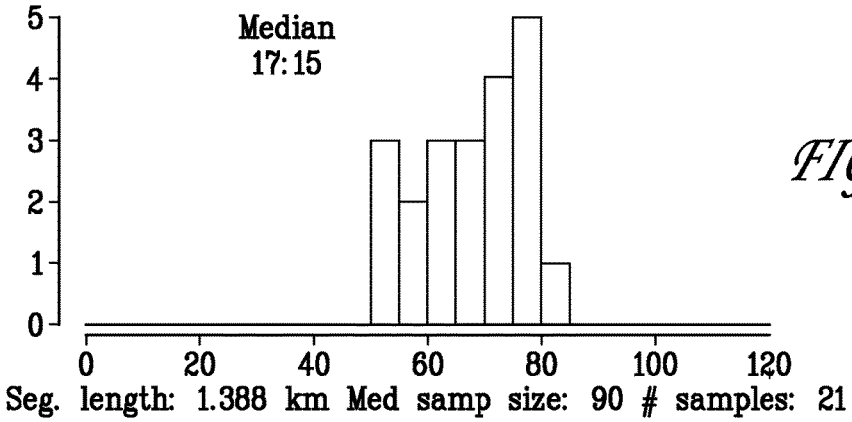
Figure 10F:
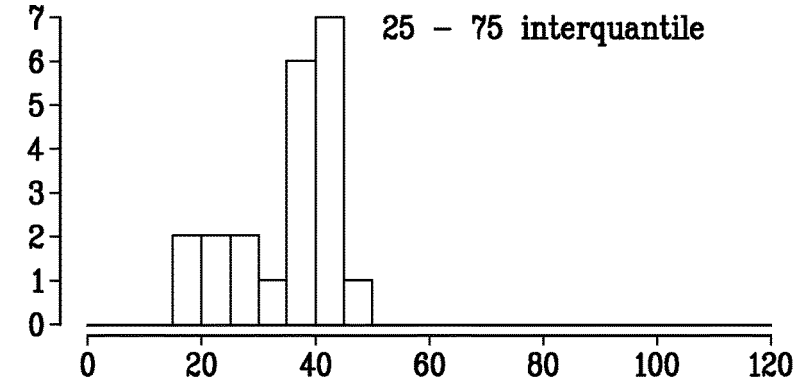
Figure 10G:
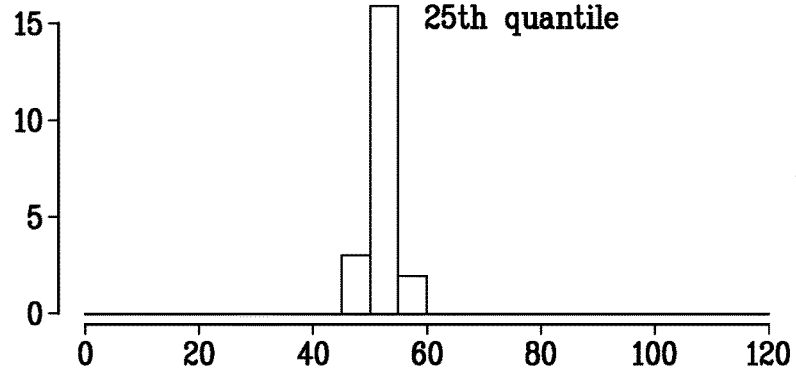
Figure 10H:
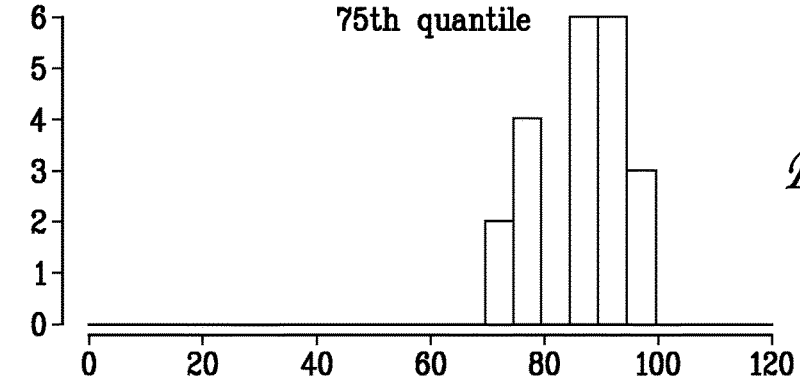
Figure 10I:
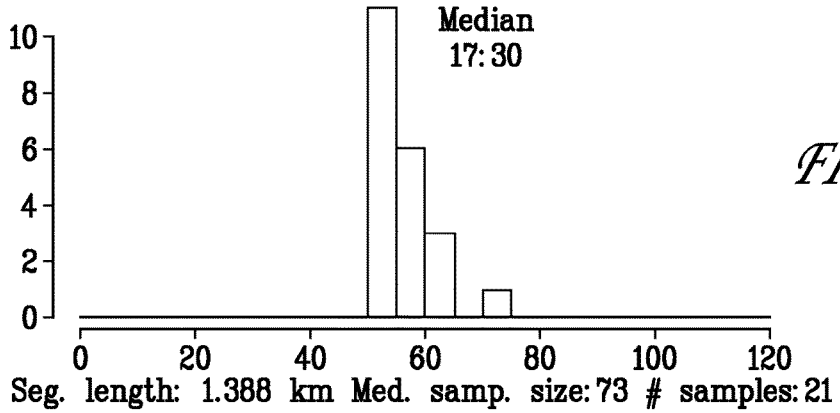
Figure 10J:
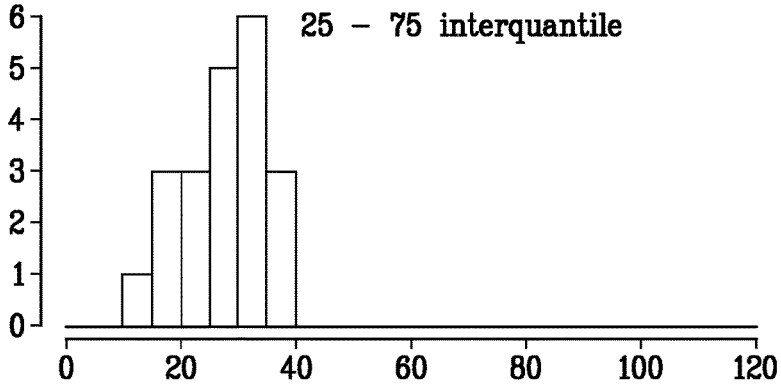
Figure 10K:
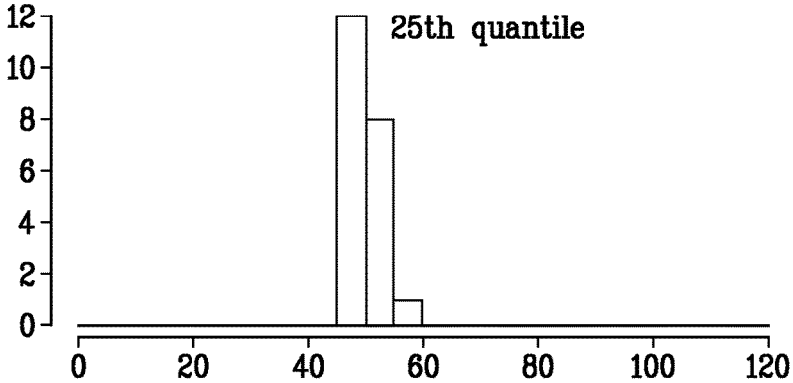
Figure 10L:
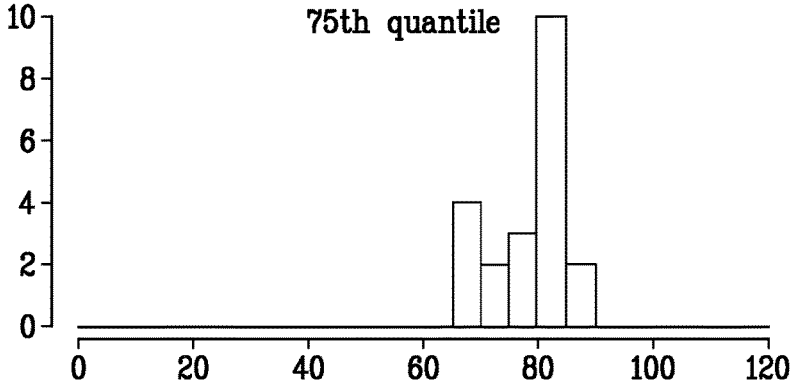
Figure 10M:
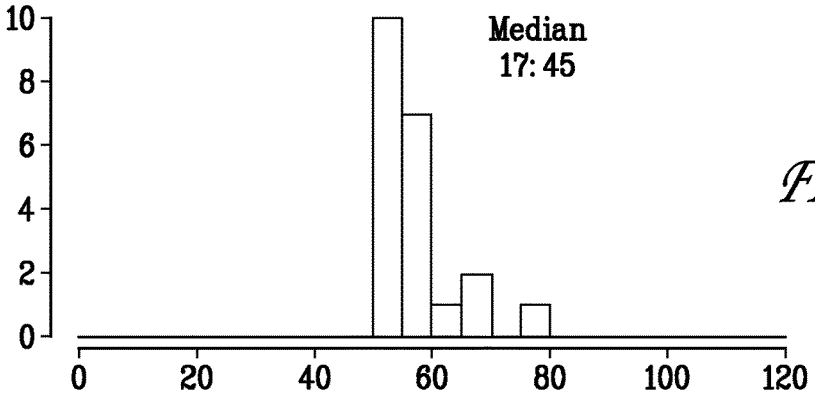
Figure 10N:
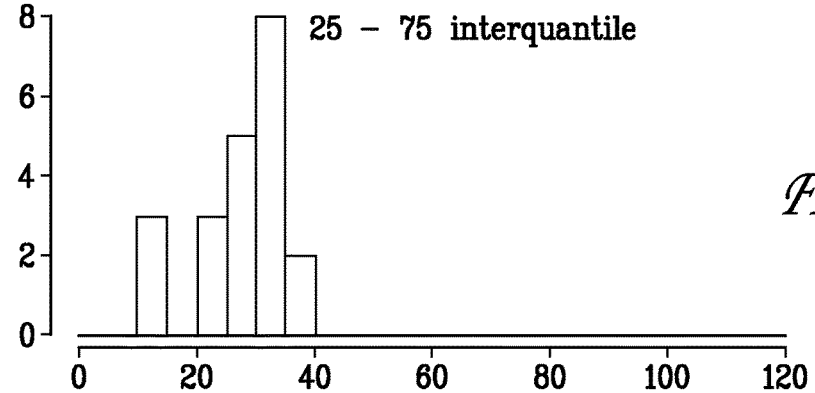
Figure 10O:
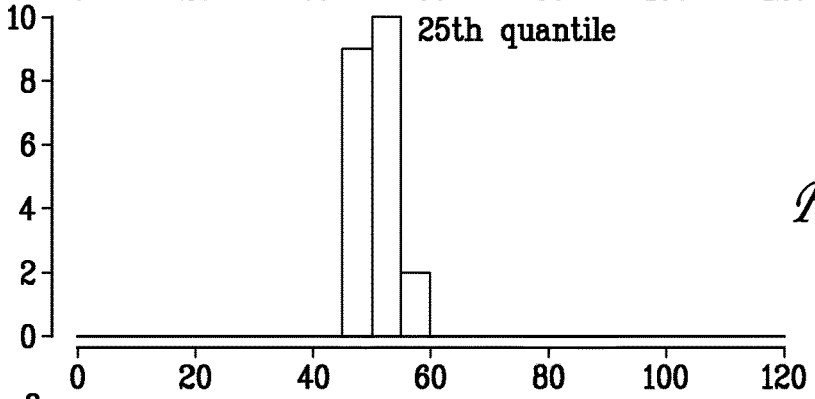
Figure 10P:
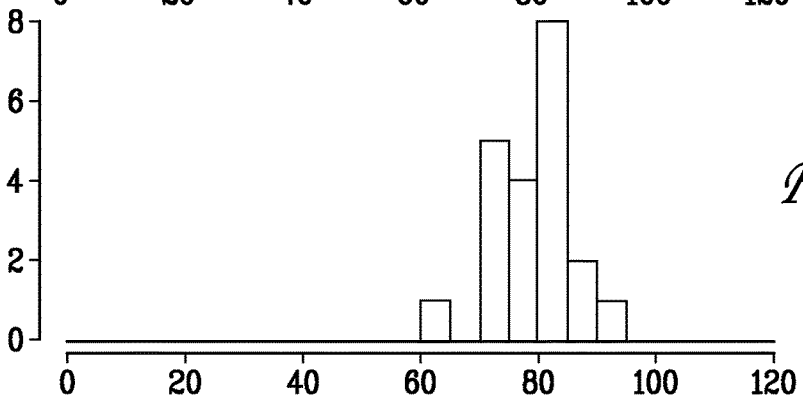
Figure 11A:
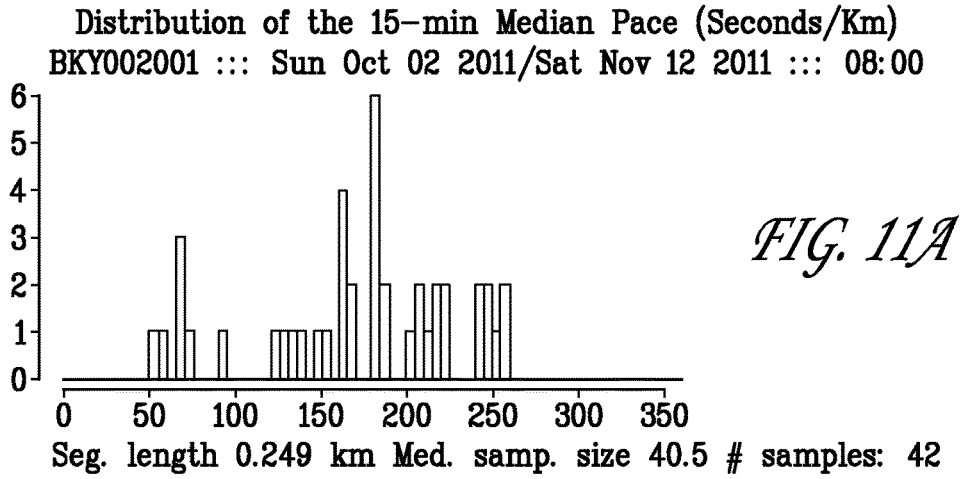
FIGS. 11A-P are yet another series of graphs showing an exemplary quantile distribution.
Figure 11B:
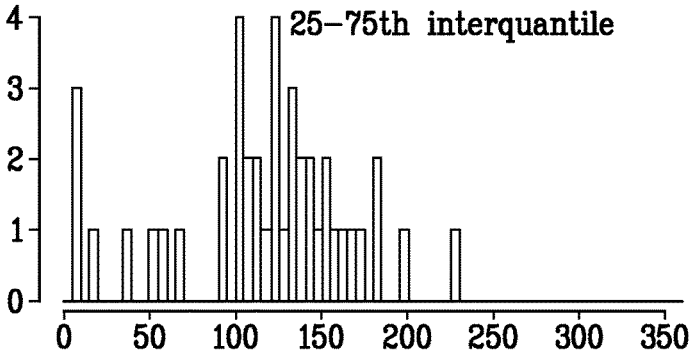
Figure 11C:
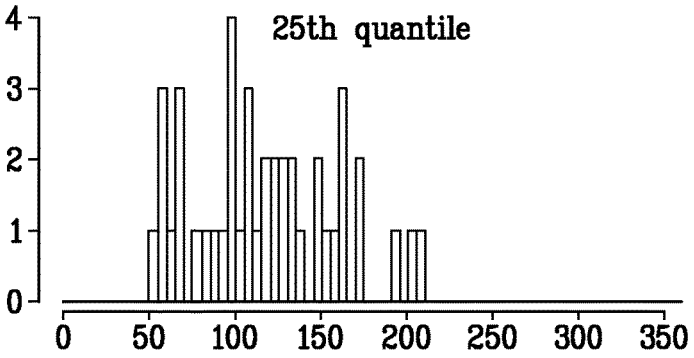
Figure 11D:
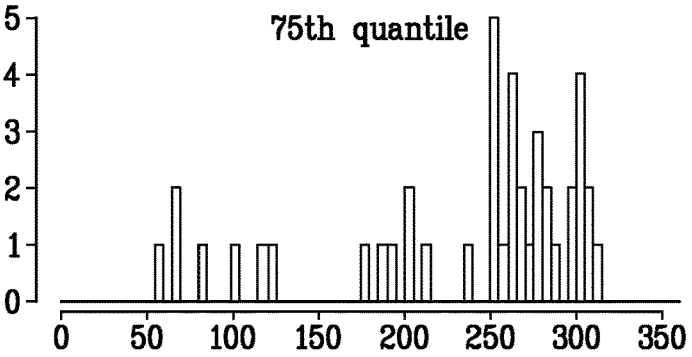
Figure 11E:
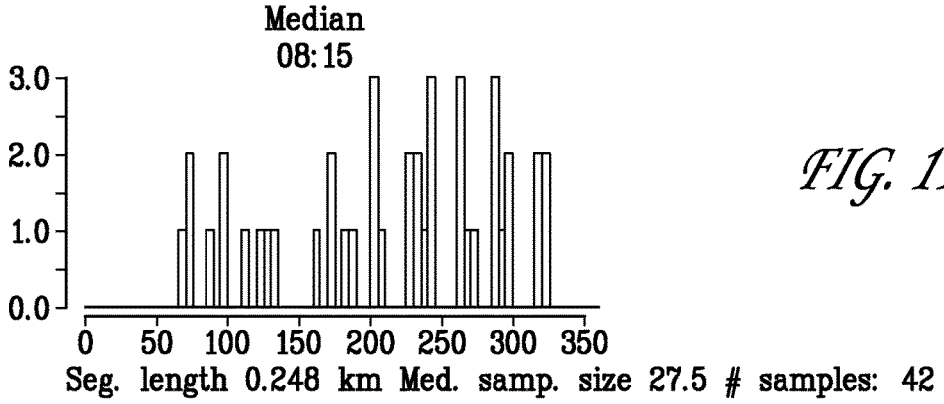
Figure 11F:
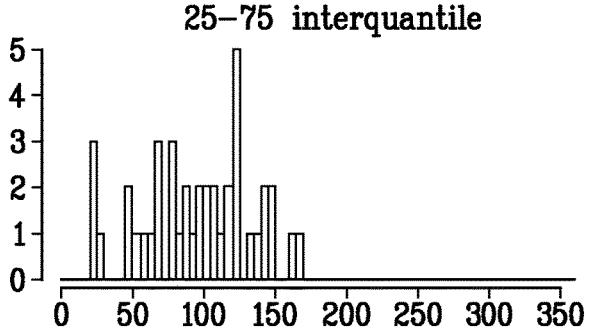
Figure 11G:
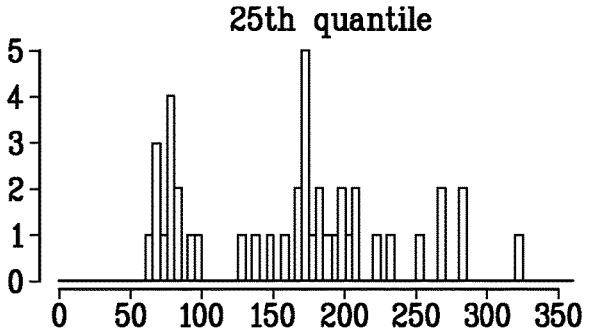
Figure 11H:
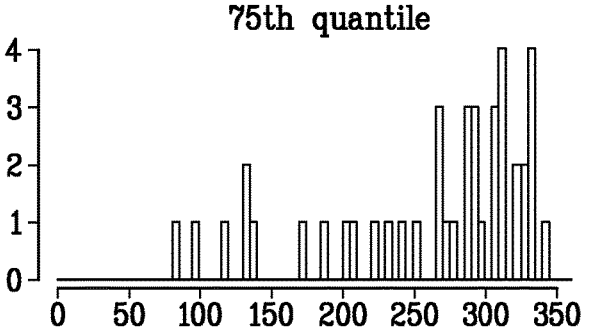
Figure 11I:
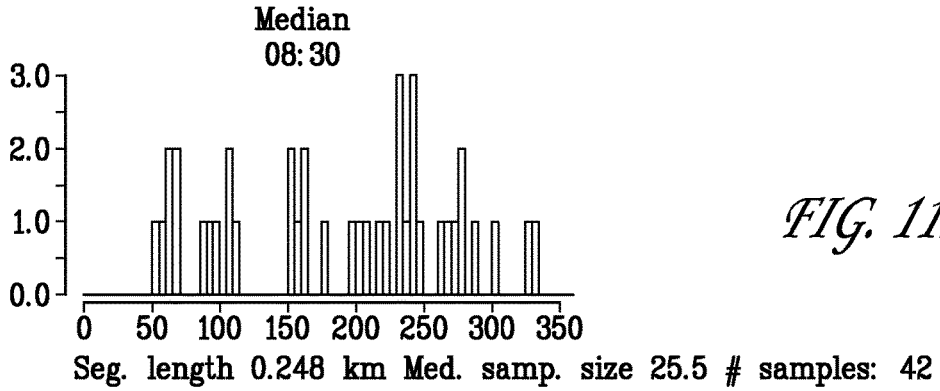
Figure 11J:
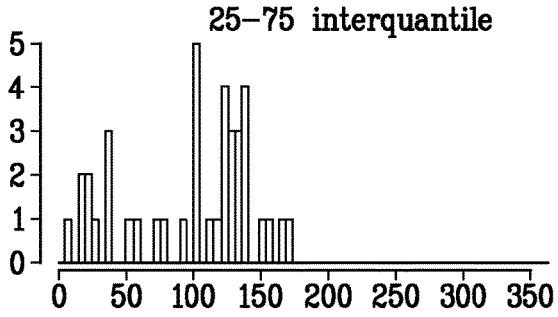
Figure 11K:
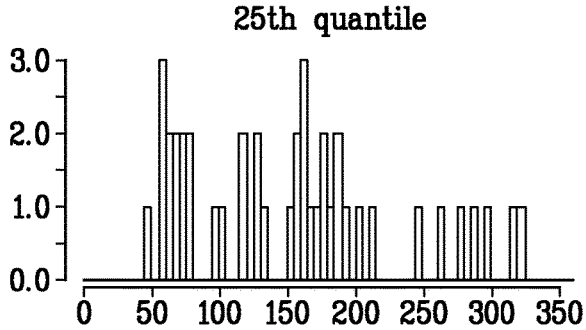
Figure 11L:
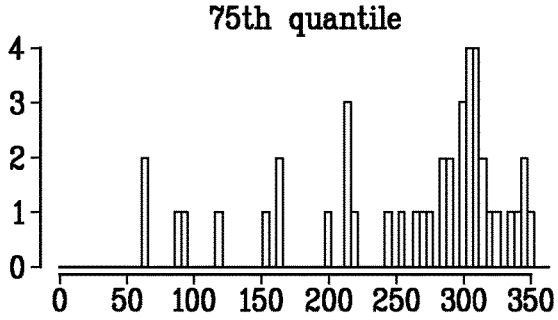
Figure 11M:
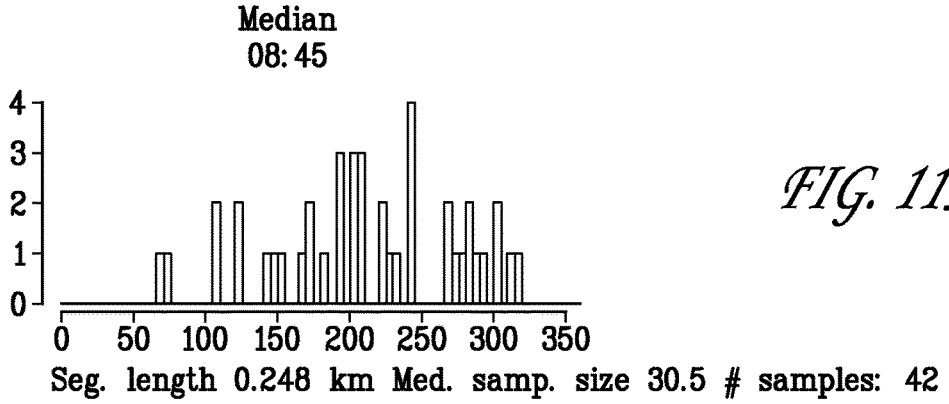
Figure 11N:
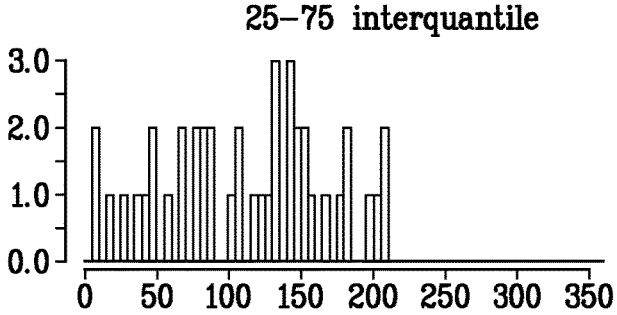
Figure 11O:
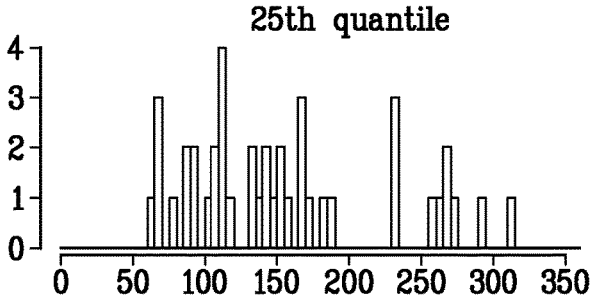
Figure 11P:
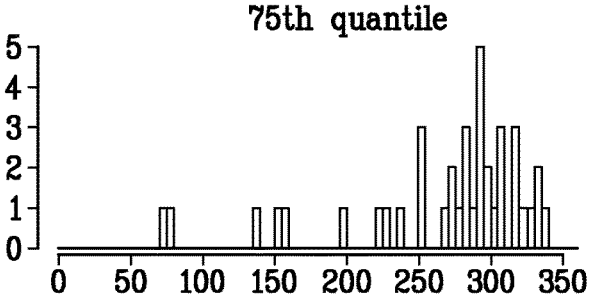

FIGS. 9A-F are another series of graphs showing the distribution of certain parameters for two consecutive time slots from approximately 30 days of data. The parameters shown may be extracted by system 100 from the individual time distributions and may include the 25th percentile, median, and 75th percentile, and determine the range of the variations contained therein. As shown in FIGS. 9A-F, system 100 may determine when certain periods of time are likely to be more congested on a signalized arterial segment. In one exemplary scenario, as shown in FIG. 9D, the median reveals seven or eight congested days at 5:15 PM (depicted as "17:15"), while FIG. 9A reveals that the traffic is relatively tamer at 5 PM (depicted as "17:00"). FIGS. 9A-F further illustrate the absolute distribution of quantiles across different days, but not necessarily the correlation between the quantile variations. FIGS. 10 A-P and 11 A-P are further series of graphs showing exemplary quantile distributions. As discussed below, a more comprehensive traffic estimation model may be generated by calibrating travel time distribution models from quantile values.

Figure 12A:
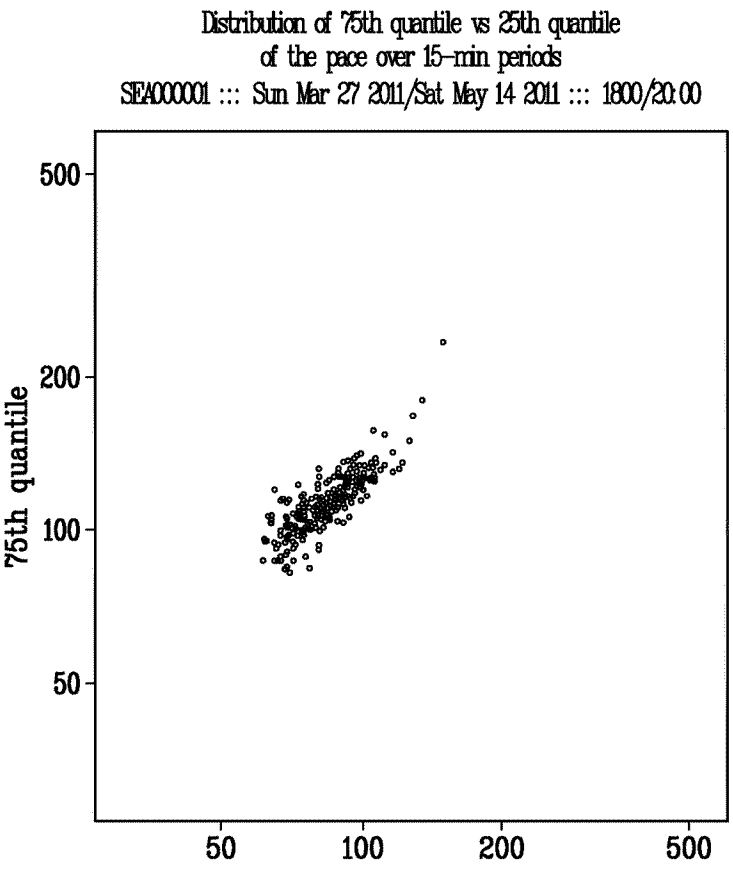
FIGS. 12A-B are a series of scatter plots mapping quantiles against one another.
Figure 12B:
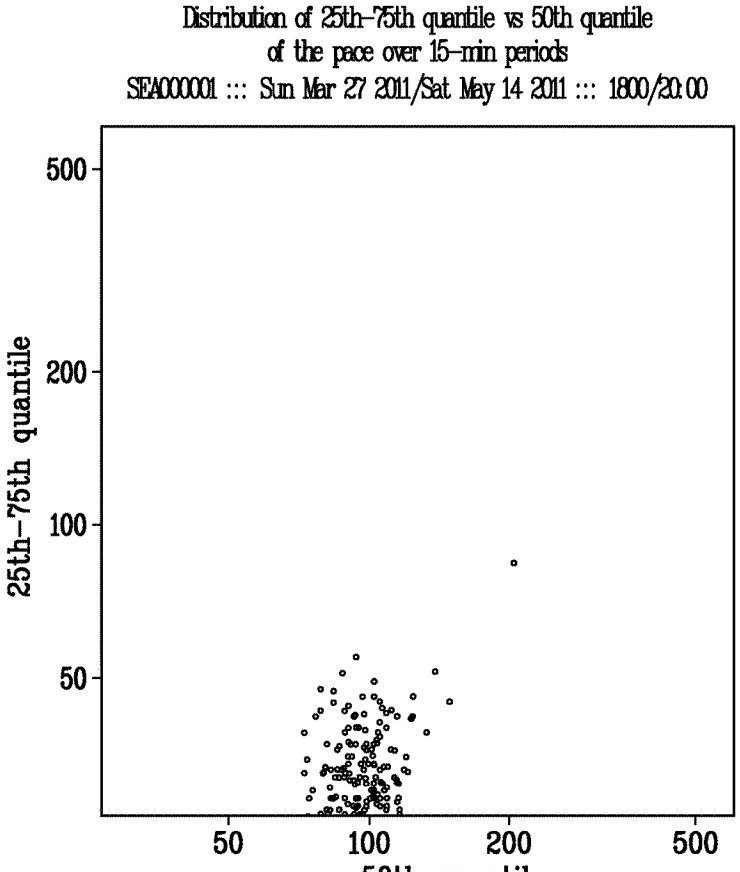

FIGS. 12A-B are a series of scatter plots mapping quantiles against one another. More specifically, FIG. 12A maps the 75th quantile against the 25th quantile, and FIG. 12B maps the 25th-75th interquantile against the median (depicted as "50th quantile"). FIGS. 12A-B show distributions over 30 days for a timeslot spanning 6 PM to 8 PM. Accordingly, each dot on the plots shown in FIGS. 12A-B represents a single fifteen-minute distribution of pace that took place between 6 PM and 8 PM. As shown in FIG. 12A, system 100 may determine that the 75th and 25th appear correlated, for example being no more than 50 seconds/kilometer apart. Such results indicate that inter-vehicular travel time variations are not insignificant but remain limited. In other instances, the correlation between quantiles may be less, corresponding to more disorganized traffic conditions.

Figures 13A, 13B, 13C:
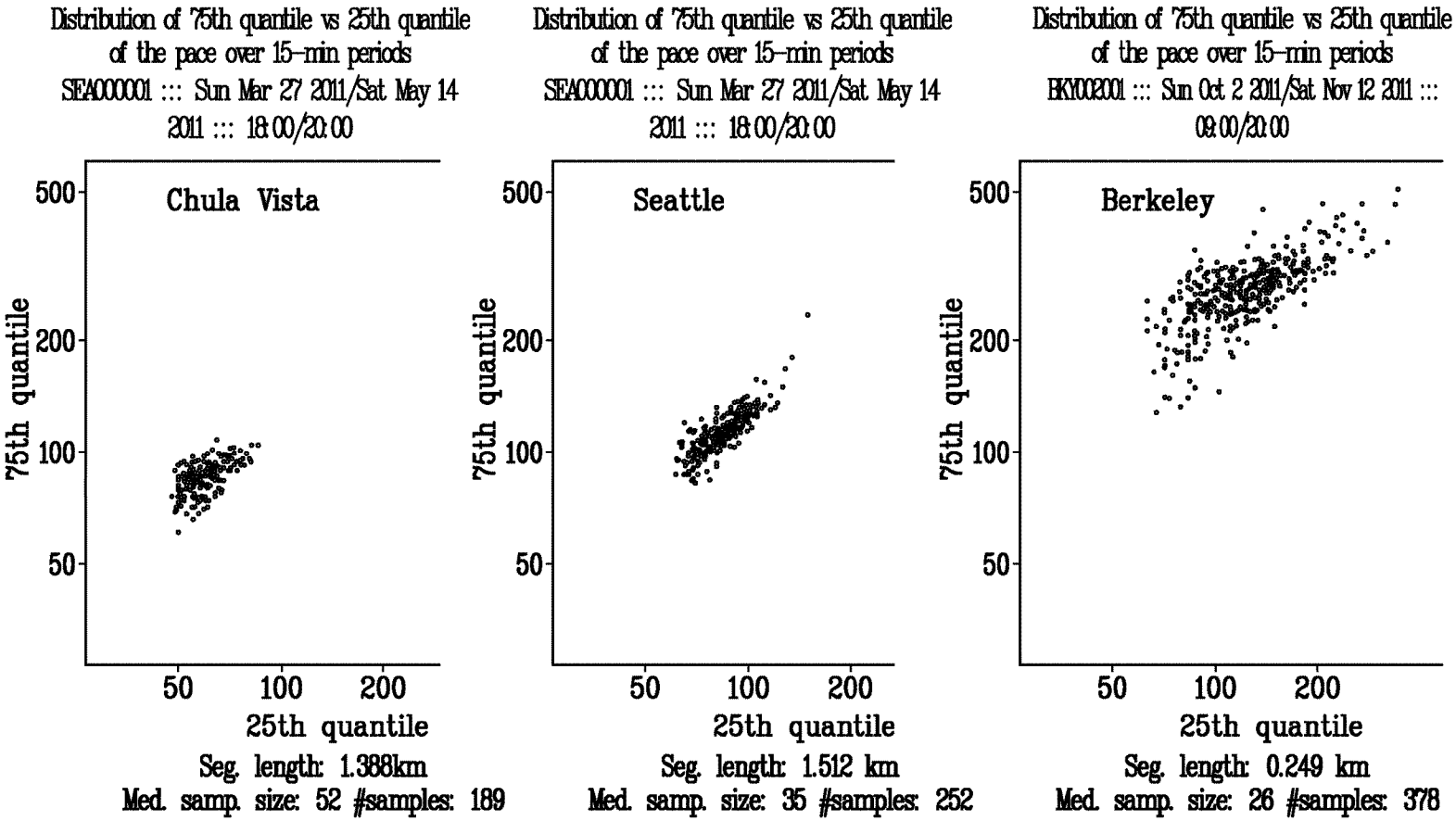
FIGS. 13A-C are another series of scatter plots mapping quantiles against one another.

FIGS. 13A-C are another series of scatter plots mapping quantiles against one another. FIGS. 13A-C map quantiles from three different locations: Chula Vista, Calif., Seattle, Wash., and Berkeley, Calif.

The system and methods disclosed herein reveal that some segments exhibit relatively little dispersion and only minor fluctuations throughout the day, while other segments seem to constantly induce delays. In some cases, travel times appear neatly distributed around a single mode. In other instances, the shape of the distribution may suggest more of a continuum. The system and methods described herein fulfill the need for a flexible model that allows different distribution shapes and can therefore provide a good to the data. To avoid being constrained by limited number of observations and low sample sizes (and posing a serious risk of over-fitting by allowing multiple dimensions for the parameter $\theta_T$), system 100 may analyze data by focusing on key percentile values as proxy descriptors for the travel time distributions. System 100 may calibrate prior distributions by analyzing density plots such as those described above over substantial periods of time. In doing so, system 100 may use universal pace distributions such that system 100 may perform Bayesian calibrations and estimations.

Figure 14:
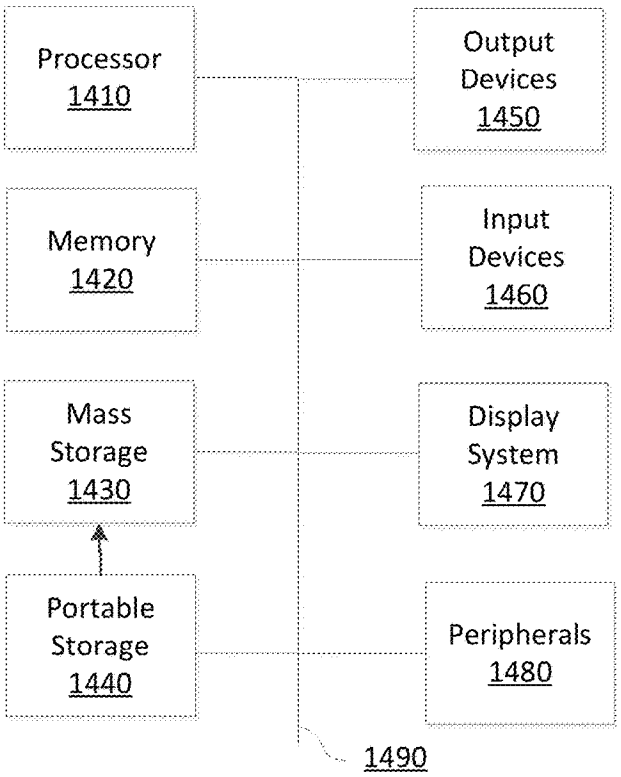
FIG. 14 is a block diagram of a device for implementing an embodiment of the presently disclosed invention.

FIG. 14 is a block diagram of a device 1400 for implementing an embodiment of the technology disclosed herein. System 1400 of FIG. 14 may be implemented in the contexts of the likes of client computer 110 and server computer 130. The computing system 1400 of FIG. 14 includes one or more processors 1410 and memory 1420. Main memory 1420 may store, in part, instructions and data for execution by processor 1410. Main memory can store the executable code when in operation. The system 1400 of FIG. 14 further includes a storage, which may include mass storage 1430 and/or portable storage 1440, output devices 1450, user input devices 1460, a display system 1470, and peripheral devices 1480. Although not shown, system 1400 may also include one or more antenna.

The components shown in FIG. 14 are depicted as being connected via a single bus 1490. The components may, however, be connected through one or more means of data transport. For example, processor unit 1410 and main memory 1420 may be connected via a local microprocessor bus, and the storage, including mass storage 1430 and/or portable storage 1440, peripheral device(s) 1480, and display system 1470 may be connected via one or more input/output (I/O) buses. In this regard, the exemplary computing device of FIG. 14 should not be considered limiting as to implementation of the technology disclosed herein. Embodiments may utilize one or more of the components illustrated in FIG. 14 as might be necessary and otherwise understood to one of ordinary skill in the art.

The storage device may include mass storage 1430 implemented with a magnetic disk drive or an optical disk drive, may be a non-volatile storage device for storing data and instructions for use by processor unit 1410. The storage device may store the system software for implementing embodiments of the system and methods disclosed herein for purposes of loading that software into main memory 1420.

Portable storage device 1440 operates in conjunction with a portable non-volatile storage medium, such as a floppy disk, compact disk or digital video disc, to input and output data and code to and from the computer system 1400 of FIG. 14. The system software for implementing embodiments of the system and methods disclosed herein may be stored on such a portable medium and input to the computer system 1400 via the portable storage device.

Antenna 440 may include one or more antennas for communicating wirelessly with another device. Antenna 440 may be used, for example, to communicate wirelessly via Wi-Fi, Bluetooth, with a cellular network, or with other wireless protocols and systems including but not limited to GPS, A-GPS, or other location based service technologies. The one or more antennas may be controlled by a processor 1410, which may include a controller, to transmit and receive wireless signals. For example, processor 1410 execute programs stored in memory 412 to control antenna 440 transmit a wireless signal to a cellular network and receive a wireless signal from a cellular network.

The system 1400 as shown in FIG. 14 includes output devices 1450 and input device 1460. Examples of suitable output devices include speakers, printers, network interfaces, and monitors. Input devices 1460 may include a touch screen, microphone, accelerometers, a camera, and other device. Input devices 1460 may include an alpha-numeric keypad, such as a keyboard, for inputting alpha-numeric and other information, or a pointing device, such as a mouse, a trackball, stylus, or cursor direction keys.

Display system 1470 may include a liquid crystal display (LCD), LED display, or other suitable display device. Display system 1470 receives textual and graphical information, and processes the information for output to the display device.

Peripherals 1480 may include any type of computer support device to add additional functionality to the computer system. For example, peripheral device(s) 1480 may include a modem or a router.

The components contained in the computer system 1400 of FIG. 14 are those typically found in computing system, such as but not limited to a desk top computer, lap top computer, notebook computer, net book computer, tablet computer, smart phone, personal data assistant (PDA), or other computer that may be suitable for use with embodiments of the technology disclosed herein and are intended to represent a broad category of such computer components that are well known in the art. Thus, the computer system 1400 of FIG. 14 can be a personal computer, hand held computing device, telephone, mobile computing device, workstation, server, minicomputer, mainframe computer, or any other computing device. The computer can also include different bus configurations, networked platforms, multiprocessor platforms, etc. Various operating systems can be used including Unix, Linux, Windows, Macintosh OS, Palm OS, and other suitable operating systems.

Figure 15:
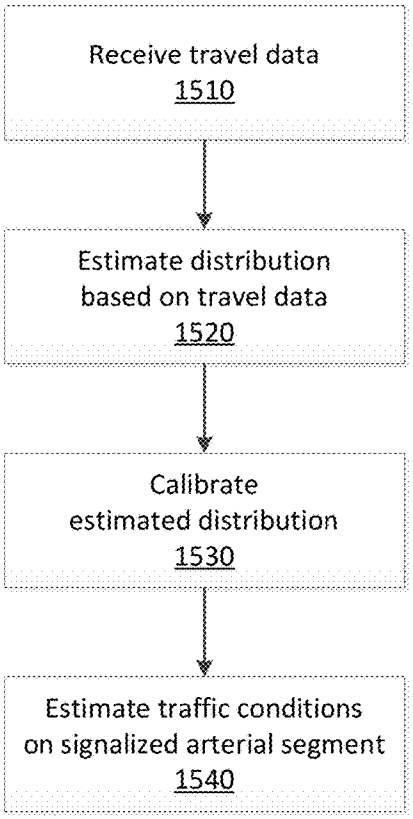
FIG. 15 shows an exemplary method for estimating traffic on signalized arterials.

FIG. 15 shows an exemplary method for estimating traffic on signalized arterials. In an embodiment, method 1500 may include receiving travel data at step 1510. As noted above, travel data may be received from mobile GPS devices, reidentification technologies, or from a third-party server that pre-collected data. Method 1500 may further include executing instructions stored in memory, wherein execution of the instructions by a computer processor estimates a distribution based on the traffic data. At step 1530, execution of the instructions by a processor may further calibrate the distribution estimated in step 1520. In some embodiments, at step 1540, method 1500 may further include estimating the traffic conditions on a particular arterialized segment at a particular time based on the calibrated distribution. Method 1500 may also include displaying the estimated traffic conditions through a graphical interface, such as on a mobile device belonging to a user. Method 1500 of FIG. 15 may be implemented by system 100 of FIG. 1.

As discussed above, the system disclosed herein builds historical knowledge about traffic conditions by accumulating measurements over time. The system then calibrates model for different times of the day and updates those models with current available data. In some embodiments, system 100 may utilize several thousands of data plots. Moreover, as discussed above, system 100 may utilize three different sources of variability: individual, daily, and day-to-day. In situations where no current data is available, the historical data alone may be used. In situations in which current data is available, such as data received by system 100 from reidentification devices, system 100 may update the historical knowledge accordingly using the Bayesian interface discussed above. In some embodiments, quantile maps like those discussed above may be utilized to accomplish such estimations.

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claims appended hereto.

What is claimed is:

1. A system for estimating time travel distributions on signalized arterials, comprising:

a processor;

memory; and an application stored in memory and executable by the processor to:

receive travel data, wherein the received travel data includes:

travel time observation of the one or more signalized arterials of interest, travel time observation of one or more nearby signalized arterials to the one or more signalized arterials of interest, and contextual evidence associated with the one or more signalized arterials of interest, estimate a first distribution on one or more signalized arterials, wherein the estimated first distribution is based on the received travel data, and wherein the first distribution comprises a linear combination of individual paces weighted by distance traveled, incorporate travel time variability components with the estimated first distribution, wherein the travel time variability components include individual variations, time-of-day variations and daily variations, and calibrate the first distribution with prior data including regular past patterns of travel times associated with the one or more signalized arterials to obtain a second distribution, wherein the second distribution is a more recent estimate of travel time compared to the first distribution, and wherein the second distribution also comprises a linear combination of individual paces weighted by distance traveled.

2. The system of claim 1, wherein the travel data is received from one or more mobile GPS devices.

3. The system of claim 1, wherein the travel data is received from one or more re-identification devices.

4. The system of claim 3, wherein the re-identification device is a magnetic signature.

5. The system of claim 3, wherein the re-identification device is a toll tag.

6. The system of claim 3, wherein the re-identification device is a license plate.

7. The system of claim 3, wherein the re-identification device is a Bluetooth receiver.

8. The system of claim 1, wherein the travel data is received from a third-party server that collected the data.

9. The system of claim 1, wherein the server is an open-source server.

10. The system of claim 1, wherein the application is executable by the processor further to update the prior data with the received travel data.

11. The system of claim 1, wherein the contextual evidence associated with the one or more signalized arterials of interest include travel data for the one or more signalized arterials related to local weather, incidents, special events, road closures or other traffic diversions.

12. The system of claim 1, wherein the application is executable by the processor further to normalize the received travel data into a unit of pace that is expressed in seconds per mile.

13. A method for estimating time travel distributions on signalized arterials, comprising:

receiving travel data, wherein the received travel data includes:

travel time observation of the one or more signalized arterials of interest, travel time observation of one or more nearby signalized arterials to the one or more signalized arterials of interest, and contextual evidence associated with the one or more signalized arterials of interest; and executing instructions stored in memory, wherein execution of the instructions by a computer processor causes the computer processor to:

estimate a first distribution on one or more signalized arterials, wherein the estimated first distribution is based on the received travel data, and wherein the first distribution comprises a linear combination of individual paces weighted by distance traveled, incorporate travel time variability components with the estimated first distribution, wherein the travel time variability components include individual variations, time-of-day variations and daily variations, and calibrate the first distribution with prior data including regular past patterns of travel times associated with the one or more signalized arterials to obtain a second distribution, wherein the second distribution is a more recent estimate of travel time compared to the first distribution, and wherein the second distribution also comprises a linear combination of individual paces weighted by distance traveled.

14. The method of claim 13, wherein the travel data is received from one or more mobile GPS devices.

15. The method of claim 13, wherein the travel data is received from one or more re-identification devices.

16. The method of claim 15, wherein the re-identification device is a magnetic signature.

17. The method of claim 15, wherein the re-identification device is a toll tag.

18. The method of claim 15, wherein the re-identification device is a license plate.

19. The method of claim 15, wherein the re-identification device is a Bluetooth receiver.

20. The method of claim 13, wherein the travel data is received from a third-party server that collected the data.

21. The method of claim 13, wherein execution of the instructions by the computer processor further causes the computer processor to estimate traffic conditions on a particular signalized arterial segment based on the calibrated distribution.

22. The method of claim 13, wherein execution of the instructions by the computer processor further causes the computer processor to display the estimated traffic conditions to a user through a graphical interface of a mobile device.

23. The system of claim 1, wherein the prior data corresponds to travel time distribution by time of day.

* * * * *